US007494299B1

(12) United States Patent
Whitsett

(10) Patent No.: US 7,494,299 B1
(45) Date of Patent: Feb. 24, 2009

(54) PILING APPARATUS HAVING ROTARY DRIVE

(76) Inventor: Michael Whitsett, 106 Ruffian Ct., Bush, LA (US) 70431

( * ) Notice: Subject to any disclaimer, the term of this patent is extended or adjusted under 35 U.S.C. 154(b) by 831 days.

(21) Appl. No.: 10/690,489

(22) Filed: Oct. 21, 2003

Related U.S. Application Data

(63) Continuation-in-part of application No. 09/993,321, filed on Nov. 14, 2001, now Pat. No. 6,814,525.

(60) Provisional application No. 60/248,349, filed on Nov. 14, 2000.

(51) Int. Cl.
*E02D 7/30* (2006.01)
*E02D 5/38* (2006.01)

(52) U.S. Cl. ..... 405/254; 405/251

(58) Field of Classification Search ..... 405/233, 405/236, 244, 249, 251, 252.1, 253, 254
See application file for complete search history.

(56) References Cited

U.S. PATENT DOCUMENTS 108,814 A * 11/1870 Moseley ..... 405/252.1
307,541 A * 11/1884 Gray et al. ..... 405/251
3,091,090 A * 5/1963 Muller ..... 405/254
3,199,300 A * 8/1965 Fiore ..... 405/251
3,263,431 A * 8/1966 Phares ..... 405/251
3,354,657 A * 11/1967 Turzillo ..... 405/244
5,459,973 A * 10/1995 Baumann ..... 52/726.1
5,707,180 A * 1/1998 Vickars et al. ..... 405/233
5,919,005 A * 7/1999 Rupiper ..... 405/244
5,934,836 A * 8/1999 Rupiper et al. ..... 405/244
5,975,808 A * 11/1999 Fujita ..... 405/244
7,220,081 B1 * 5/2007 Gantt, Jr. ..... 405/251
2004/0076479 A1 * 4/2004 Camilleri ..... 405/252.1

* cited by examiner

*Primary Examiner*—Michael Safavi
(74) *Attorney, Agent, or Firm*—Keaty Professional Law Corporation

(57) ABSTRACT

An in-situ pile apparatus 10 includes a helical anchor to which a plurality of elongated generally cylindrically shaped sections can be added. Each of the sections has a specially shaped end portion for connecting to another section. An internal drive is positioned in sections inside the bore of each of the connectable pile sections. The internal drive includes enlarged sections that fit at the joint between pile sections. In one embodiment, the internal drive can be removed to leave a rod behind that defines reinforcement for an added material such as concrete. The rod also allows for a tension rod connection from the anchor tip to an upper portion attachment point.

1 Claim, 19 Drawing Sheets

PILING APPARATUS HAVING ROTARY DRIVE

CROSS-REFERENCE TO RELATED APPLICATIONS

Priority of U.S. Provisional Patent Application Ser. No. 60/248,349, filed Nov. 14, 2000, incorporated herein by reference, is hereby claimed. This is a continuation in part of Ser. No. 09/993,321 filed Nov. 14, 2001, now U.S. Pat. No. 6,814, 525, the priority of which is claimed and the full disclosure of which is incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to composite piling and more particularly to a piling apparatus that includes a helical anchor lower end portion to which a plurality of connectable sections can be added, each section having a hollow interior through which a drive member can pass, and each section being joined to another section at a joint that has a specially shaped fitting to be engaged by an enlarged portion of the drive member.

2. General Background of the Invention

Piling must often be installed in locations wherein a full size pile driving rig simply cannot be positioned. For example, if a building is having a settlement problem, piling must necessarily be driven below the building to support its lower most structural aspect, such as the lowest concrete horizontal section or slab.

It has been known in the art to cut holes through the slab of a building and then install a screw type anchor or screw type anchor piling system, in order to add support to an existing piling system that is already under the building. Once these additional piling have been placed, structural ties can be made between the building itself and the new piling.

Because pile driving equipment is not able to fit into the ground floor of existing buildings, a screw threaded piling or helical anchor is employed because it can be installed using a hydraulic rotary drive, for example. Such drive units are commercially available.

High capacity pile driving equipment is large and cumbersome to operate in confined areas. Conventional pile driving equipment can cause stress and fatigue on adjacent structures from weight and vibration.

Piles are used to support structures, such as buildings, when the soil underlying the structure is too weak to support the structure. There are many techniques that may be used to place a pile. One technique is to cast the pile in place. In this technique, a hole is excavated in the place where the pile is needed and the hole is filled with cement. A problem with this technique is that in weak soils the hole tends to collapse. Therefore, expensive shoring is required. If the hole is more than about 4 to 5 feet deep then safety regulations typically require expensive shoring and other safety precautions to prevent workers from being trapped in the hole.

It is known to provide a cylindrical foundation support element having an open lower end and which may be rotatably driven into the ground by virtue of the provision of an integral annular helix permanently affixed to the outer surface of the lower end of the support. The helix has an earth penetrating edge, and in conjunction with the cylindrical foundation defines an opening through which soil is allowed to pass into the chamber formed by the cylindrical wall of the foundation support. The opposite end of the cylindrical foundation support is adapted for releasable locking engagement to a drive element, which is used to rotate the support in a given direction, thus driving the support into the ground to a desired depth.

Langenbach Jr., U.S. Pat. No. 4,678,373 discloses a method for supporting a structure in which a piling beating a footing structure is driven down into the ground by pressing from above with a large hydraulic ram anchored to the structure. The void cleared by the footing structure may optionally be filled by pumping concrete into the void through a channel inside the pile. The ram used to insert the Langenbach Jr. piling is large, heavy and expensive.

Another approach to placing piles is to insert a hollow form in the ground with the piles desired and then to fill the hollow form with fluid cement. Hollow forms may be driven into the ground by impact or screwed into the ground. This approach is cumbersome because the hollow forms are unwieldy and expensive. Examples of this approach are described in U.S. Pat. Nos. 2,326,872 and 2,926,500.

Helical pier systems, such as the CHANCE™ helical pier system available from the A. B. Chance Company of Centralia, Mo. U.S.A., provide an attractive alternative to the systems described above. As described in more detail below, the CHANCE helical pier system includes a helical screw mounted at the end of a shaft. The shaft is configured to draw the helical screw downwardly into a body of soil. The screw is screwed downwardly until the screw is seated in a region of soil sufficiently strong to support the weight which will be placed on the pier.

Many piling systems have been patented that include multiple sections, some of which are provided with screw anchors or helical anchors.

An early patent is the Gray patent entitled "metal Pile", U.S. Pat. No. 415,037.

The Stevens U.S. Pat. No. 1,087,334, discloses and incased concrete piling.

A method for installing anchoring or supporting columns in situ is disclosed in U.S. Pat. No. 3,354,657.

A piling that includes a cylindrical foundation support drivable into ground with a removable helix is disclosed in the Holdeman U.S. Pat. No. 5,066,168.

The Watts U.S. Pat. No. 3,422,629 discloses a construction support system and method and apparatus for construction thereof. A helical member is part of the apparatus.

U.S. Pat. No. 3,864,923 discloses a method and means for providing a pile body in an earth situs, including driving casing into situs to define a cavity of required depth. An auger positioned within the casing is rotatable in screwing direction to remove earth from defined cavity, and carries expansible cutter means rotatable with auger to enlarge cavity girth below inner end of casing. Earth removed from casing and cavity enlargement is replaced with different material, such as self-hardenable cement, to form pile body with load carrying enlargement at inner end of casing.

An earth auger, is disclosed in U.S. Pat. No. 3,938,344 in which an auger shaft is provided with freely expansible and contractible rotary blades in such manner that said rotary blades may expand automatically when said auger shaft is rotated in the forward direction and may contract automatically when said auger shaft is rotated in the reverse direction. Also a method for driving piles and the like is disclosed which comprises the steps of positioning a pile or shoring adjacent to said auger shaft and above said blades, advancing said pile or the like into an earth bore excavated by said rotary blades, and filling said bore excavated by the rotary blades with mortar or the like.

The Turzillo U.S. Pat. No. 3,962,879 discloses a concrete pile or like concrete column formed in earth situs by rotating a continuous flight auger consisting or one or more sections into the earth to form a cavity of given depth; rotating the auger to remove augured earth from the cavity without removing the auger therefrom, and replacing the removed earth from the auger flights with fluid cement mortar, which hardens to form a column reinforced by the auger resultantly anchored in the same. A plurality of, short auger sections may be connected together in succession during drilling to form a cavity of requisite depth by increments when low headroom conditions exist. A portion of the auger or a shaft portion without auger flighting thereon may also protrude above the earth situs for extension through water and the like and be filled with cementitious material which is allowed to harden. The method may also include first filling the auger shaft with the fluid mortar and allowing the same to harden in the shaft with a passage extending therethrough, and supplying more mortar through the passage to fill the cavity to form the column against backing of hardened mortar in the shaft.

The Vickars U.S. Pat. No. 5,707,180 discloses a method and apparatus for forming piles in situ. The '180 patent provides a method for making piles and apparatus for practicing the method. The piles may be used to support the foundation of a structure, such as a building. The method draws a soil displacer on a shaft down through a body of soil by turning a screw at the lower end of the shaft. The soil displacer forces soil out of a cylindrical region around the shaft. The cylindrical region is filled with grout to encapsulate and strengthen the shaft. The grout may be fed by gravity from a bath of grout around the shaft. The soil displacer has a diameter smaller than a diameter of the screw and may be a disk extending in a plane generally perpendicular to the shaft.

BRIEF SUMMARY OF THE INVENTION

The present invention provides an improved method and apparatus for forming piles in situ. The apparatus of the present invention includes a lower helical screw anchor to which are attached a number of add on sections.

The present invention utilizes a screw threaded piling or helical anchor because it can be installed in confined areas, using smaller and more agile equipment (such as a Bobcat® type skidsteer equipped with a boom mounted hydraulic powered high torque planetary auger drive made by Eskridge, for example). Such units as these are commercially available.

In the preferred embodiment, each section is in the form of a hollow member (eg. thin wall pipe such as 0.188" wall thickness or 0.125 wall thickness or Schedule 10 pipe) having a bore that receives a drive member or tool. The outer surface of each of the sections has soil displacing ribs that aid in pushing soil away from the sections as the pile apparatus is screwed down into the earth. The hollow bore of each of the sections receives an elongated drive member. The drive member is comprised of connectable sections wherein each of the connectable drive sections is about the same length as each of the pile sections. An enlarged drive member is provided at intervals as part of the drive member, the enlarged section registering with a correspondingly shaped joint that connects two pile sections together.

The present invention provides an improved method and apparatus for installing an in-situ pile apparatus.

A lower helical anchor lead unit with variable size helical discs is screwed into the soil, followed by a conically shaped cutting and soil displacing unit. This unit has strategically placed (2-4) triangular ribs for cutting and displacing soil outwardly away from the sectional pipe sections. This same unit will work as a pile cap for concrete that is poured into upper pipe sections. With this improved shape, it cuts the soil when rotated. The upper flat round plate of the conical will work as a bearing plate to the soil.

Once the conical unit has reached the soil, a drive-tool will be attached to the helical lead unit, connected with a plastic or wooden dowel placed through the typical bolt hole.

A formed (thin wall 0.188" or Schedule-10 0.125") pile section that has squared ends is placed over the drive tool and bolted to the conical unit. Silicone caulking can be installed at each square section makeup joint to prevent water or mud from entering the pipe sections.

A hydraulic planetary drive unit is attached to the square drive tool. The hydraulic auger driver unit is engaged and the helical anchor, conical unit, attached pipe section(s) will be screwed downwardly into the soil. The hydraulic auger unit is then stopped and removed.

A second drive installation tool is bolted to the first. A second formed square sectional hollow form is placed over the drive tool and bolted. The hydraulic planetary drive unit is placed on top of the drive tool and the complete pile section is then screwed down into the soil until the top section reaches near ground level. This same process of installing drive tools and sectional hollow form units is repeated until the proper depth form has been reached (i.e. to satisfy the pile load requirements). As the complete pile unit is screwed down into the earth, the soil displacer ribs will push the soil outward away from the hollow pipe sections, creating less friction on the sections and therefore less torque.

With the proposed pile apparatus, the helical anchor will pull the hollow pipe forms down. At the same time the soil displacer ribs push the soil radially. This will allow the pile to penetrate deeper with less friction and a truer ft. lb. torque to capacity ratio. This method allows the pile to be installed as a point bearing pile, relying on the capacity of the helical discs that are screwed into the soil. In time, soil will reconsolidate around the larger diameter pipe forms which will develop a known friction capacity which will increase the overall pile capacity.

In one embodiment, a rod is provided that can be left with the pile section upon completion of installation to act as tensile rod or reinforcement for concrete that can be added to the internal bores of the various pile sections as connected end to end.

In another embodiment, plastic pipe sections can be added to the pile sections such as for example in water installations, the plastic pipe sections extending between the mud line and water surface.

Other embodiments show various connectors for attaching the internal drive members together and for connecting the rod sections together.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1A:
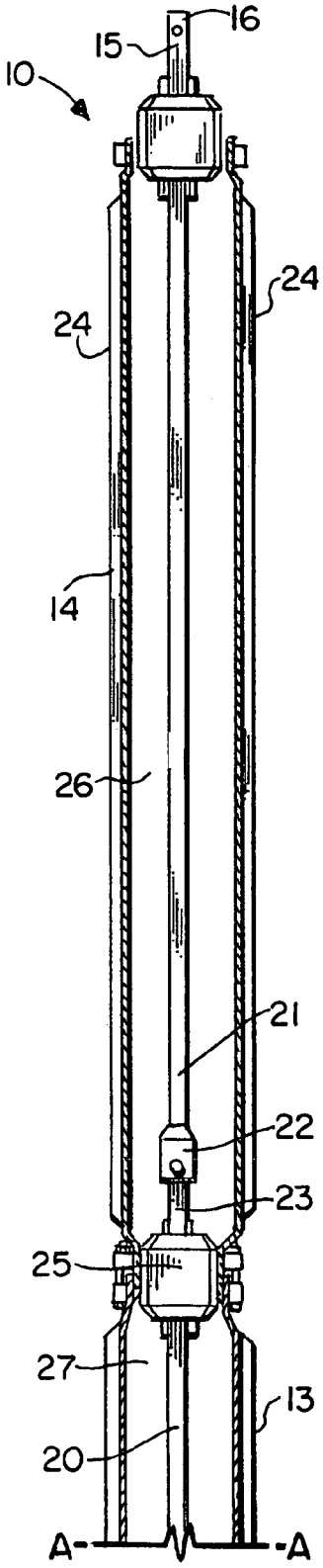
FIGS. 1A-1C disclose the preferred embodiment of the apparatus of the present invention, wherein FIG. 1A fits the drawing FIG. 1B at match line A-A and wherein the drawing FIG. 1B fits the drawing FIG. 1C at match line B-B.
Figure 1B:
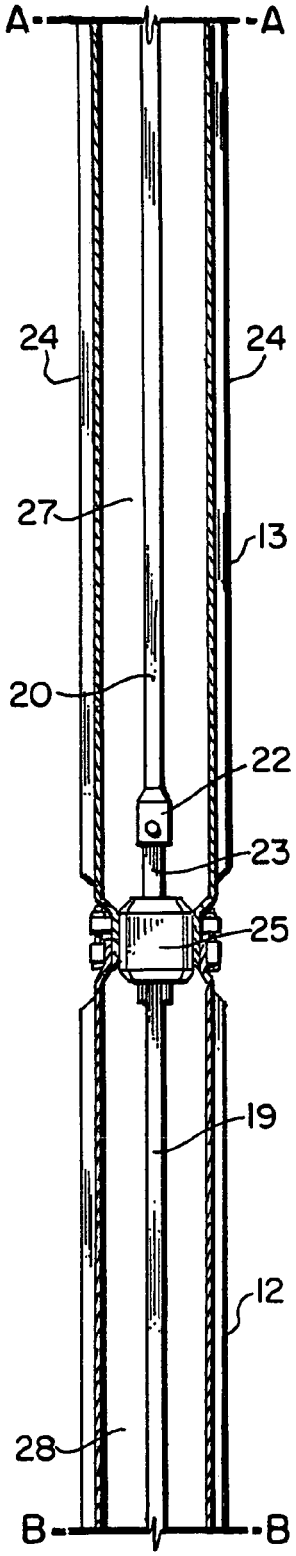
Figure 1C:
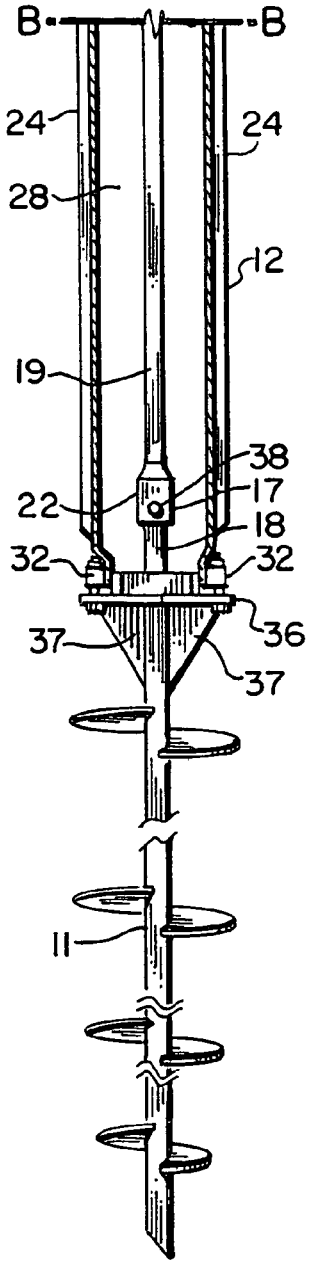

In FIGS. 1A-1C, the preferred embodiment of the apparatus of the present invention is designated generally by the numeral 10. It should be understood that in order to fit an entire elevation, sectional view of the apparatus 10 of the present invention on a single page, matchline type drawings are used wherein FIG. 1A fits to the top of FIG. 1B along matchlines A-A. Similarly, FIG. 1C fits to the bottom of FIG. 1B at matchlines. In situ pile apparatus 10 includes generally a lowermost, first section in the form of helical anchor 11, a second section 12 which is a hollow pile form section, a third section 13 and a fourth section 14. The third and fourth sections 13, 14 are also hollow pile form sections. Each section 12, 13, 14 has an internal bore. Section 12 has bore 28. Section 13 has bore 27. Section 14 has bore 26.

In the preferred embodiment, the sections 12, 13, 14 are preferably interchangeable pile sections. An internal drive member 15 extends through a hollow bore of each of the sections 12, 13, 14. The drive member 15 has an upper end portion 16 to which a commercially available hydraulic rotary drive motor can be attached. The drive member 15 has a lower end portion 17 that forms an attachment with an extension 18 at the upper end of helical anchor 11.

The drive member 15 can be comprised of a number of connectable sections as shown, including drive sections 19, 20, 21. Each drive section 19, 20, 21 provides a lower connector 22 (for example, a female connector) that forms a connection with an upper connector 23 (for example, a male connector). The lowest drive section 19 provides a connector 22 that forms a connection with extension 18 of helical anchor 11 as shown in FIG. 1C.

The internal drive 18 and member 15 is positioned internally of pile sections 12, 13, 14 and occupying the respective bores 28, 27, 26 as shown in FIGS. 1A, 1B, 1C, 2, 4, and 11-13.

Figure 2:
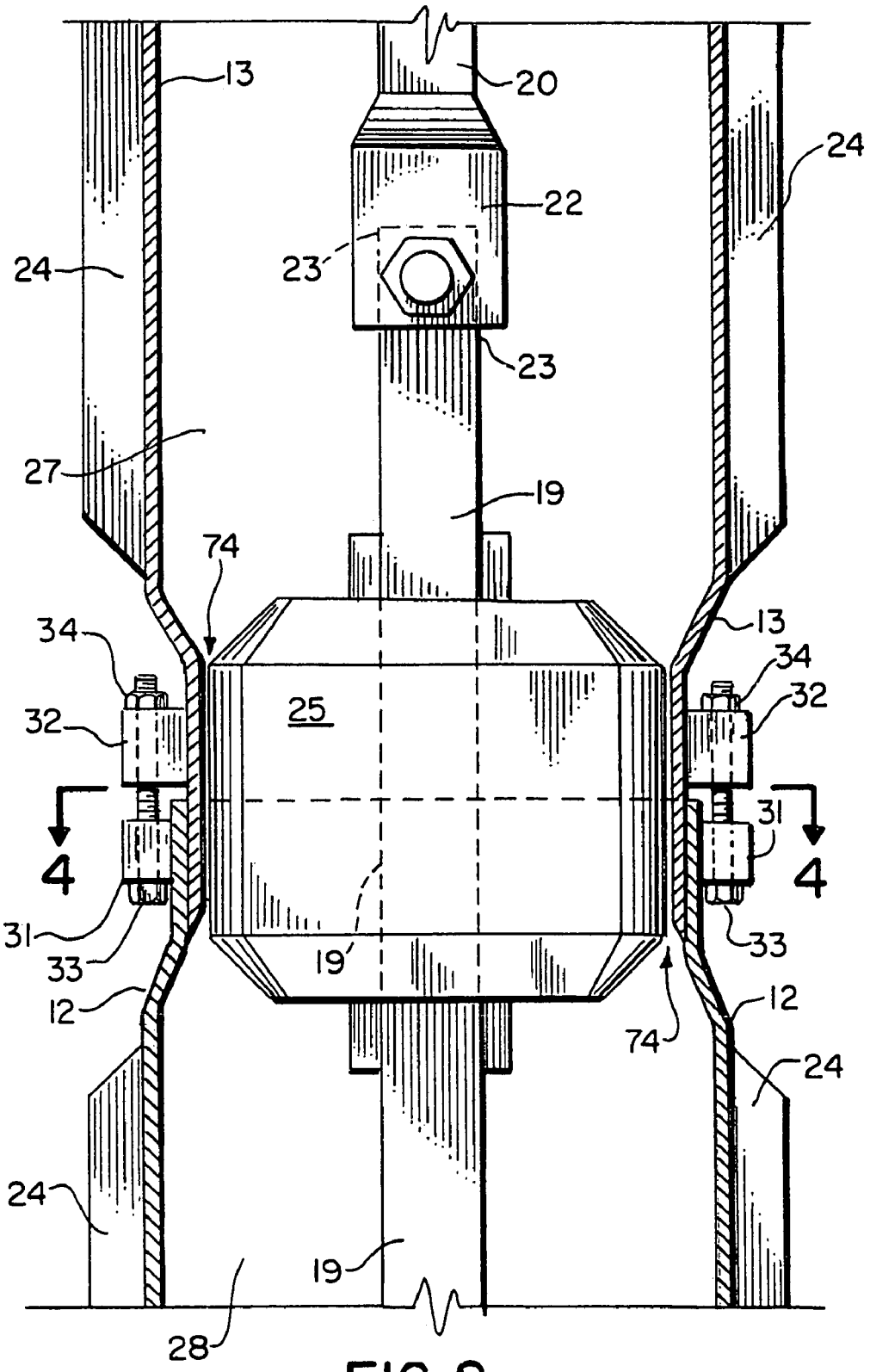
FIG. 2 is a schematic sectional elevational view of the preferred embodiment of the apparatus of the present invention illustrating a joint between two pile sections.

In FIG. 2, an enlarged view shows the joint between second section 12 and third section 13. It should be understood that a similar connection is formed between section 13 and section 14. In FIG. 2, each of the sections 12, 13 has a plurality of circumferentially spaced radially extending soil displacing ribs 24. Soil displacing ribs 24 can also be seen in the plan view of FIG. 4. The drive section 19 carries an enlarge drive member as shown in FIGS. 2 and 5.

Figure 3:
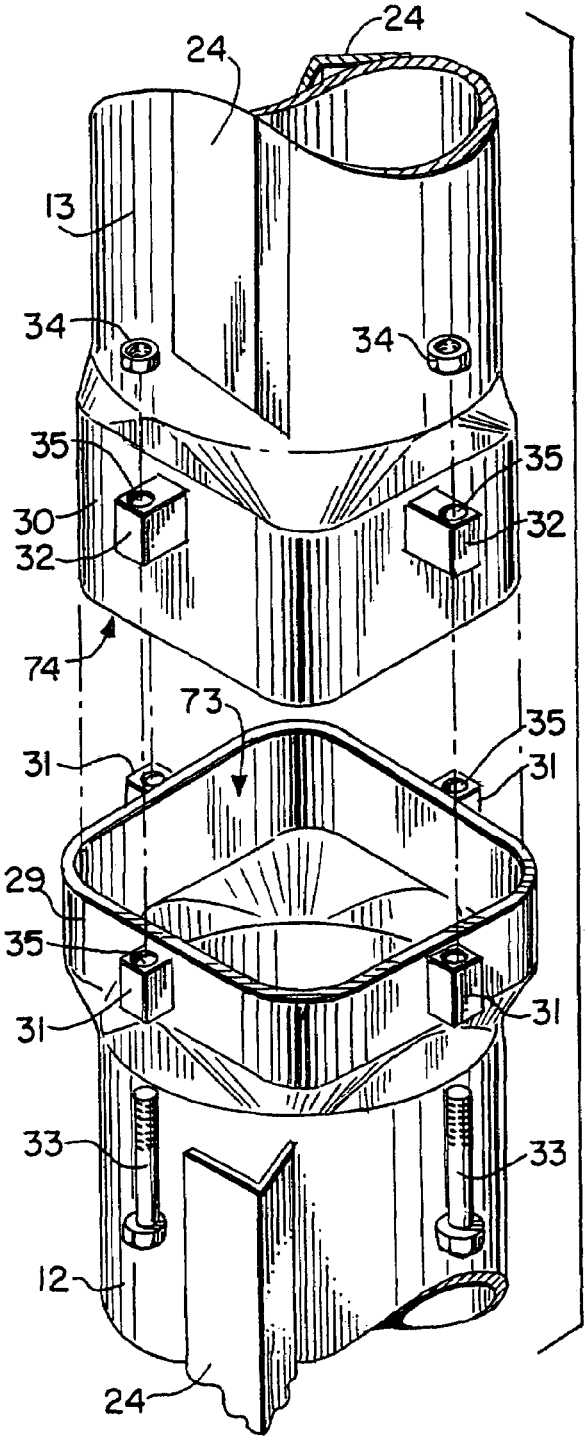
FIG. 3 is a partial, perspective view of the preferred embodiment of the apparatus of the present invention.
Figure 4:
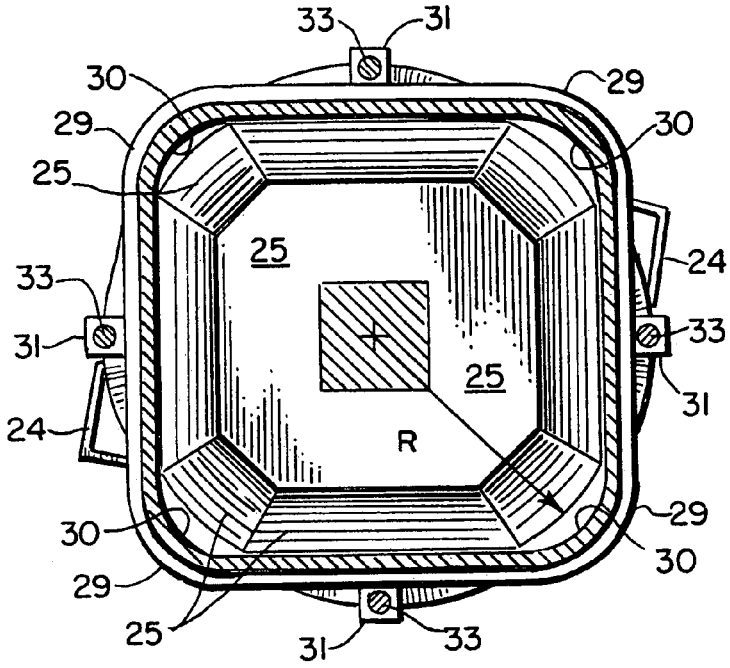
FIG. 4 is a sectional view taken along lines 4-4 of FIG. 2.
Figure 5:
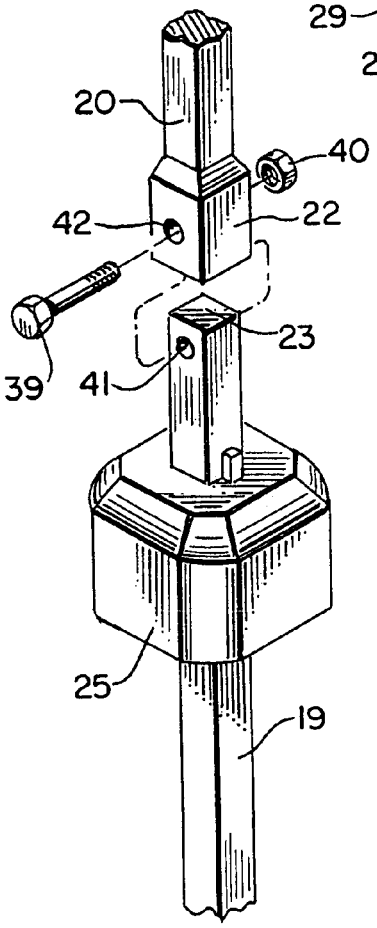
FIG. 5 is a partial perspective view of the preferred embodiment of the apparatus of the present invention illustrating the drive portion thereof.
Figure 6:
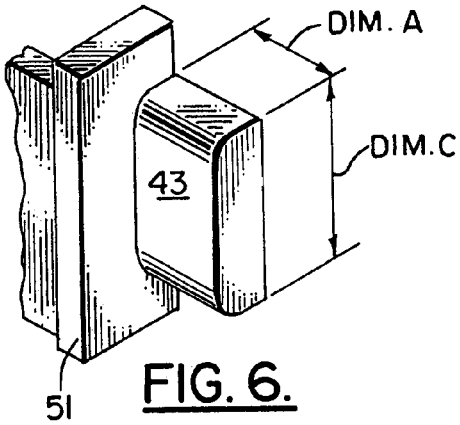
FIGS. 6 and 7 are partial perspective views of the preferred embodiment of the apparatus of the present invention illustrating die members that can be used to form the joint that is at the end of each of the pile sections.
Figure 7:
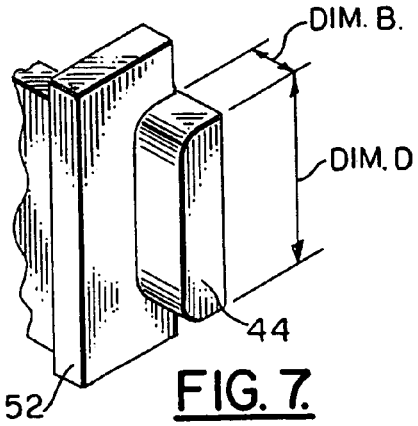

In FIGS. 2, 3, and 4, the details of a connection between a pair of pile sections is shown such as, for example, between the second pile section 12 and the third pile section 13. In FIGS. 2-4, the pile section 12 has an upper end portion that provides an upper squared end portion 29. Similarly, the third pile section 13 provides a lower square end portion 30 that has a socket 73 that is slightly smaller than the square end portion 29 so that the end portion 30 fits into the section 29 at socket 73 forming a snug fit therewith.

Each of the square end portions 29-30 provides a plurality of lugs. The upper square end portion 29 provides a plurality of lugs 31. The lower square end portion 30 provides a plurality of lugs 32. Each of the lugs 31, 32 provides an opening 35 through which a bolted connection can be placed as shown in FIGS. 1A-1C, and 2-4. The bolted connections include a plurality of bolts 33 and a plurality of nuts 34 as shown.

As shown in FIG. 2, the lower squared end portion 30 at the bottom of pile section 13 fits snugly into the socket 73 of upper square end portion 30 at the top of pile section 12. As shown in FIG. 2, enlarged drive member 25 of internal drive member 15 closely fits and conforms to the assembly of upper square end portion 29 and lower end portion 30 as shown. Enlarged drive member 25 occupies the socket 74 at the lower end portion of pile section 13 (see FIG. 2).

In the preferred embodiment, an enlarged drive member 25 is positioned at every joint between pile sections such as shown in FIGS. 1A-1B. However, it should be understood that any desired number of pile sections 12, 13, 14 can be added to configure or "make-up" a very long pile apparatus. As each pile section 12, 13, 14 is added, an additional drive section such as 19, 20, 21 is added, in each case an enlarged drive member 25 registering at the joint between sections such as 12 and 13 as shown in FIG. 2.

Figure 11:
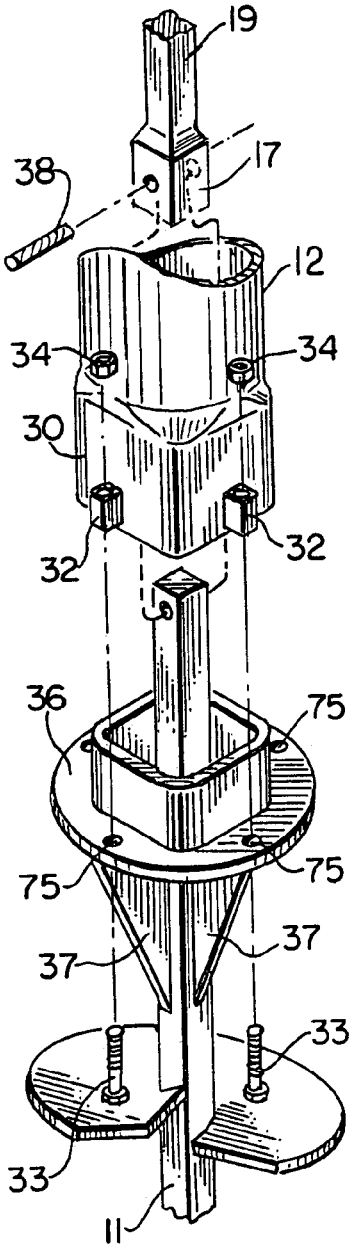
FIG. 11 is a partial, perspective view of the preferred embodiment of the apparatus of the present invention.

When bolting the helical anchor 11 to lower square end portion 30 of a pile section such as 12 (see FIG. 11), the anchor 11 provides a round plate 36 having peripheral openings 75 through which bolts 33 can pass as shown in FIG. 1C. For stiffening and soil cutting and soil displacement purposes, a plurality of radially extending triangular plates 37 are provided at the upper end portion of helical anchor 11 just below plate 36 as shown in FIG. 1C and 11.

Figure 13A:
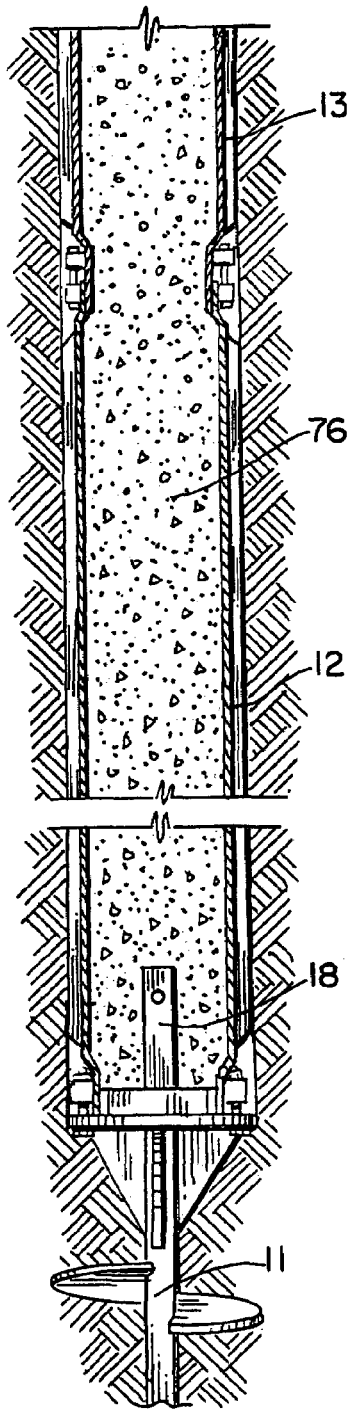
FIG. 13A is a partial, sectional view of the preferred embodiment of the apparatus of the present invention showing drive tool removed and concrete added.
Figure 13:
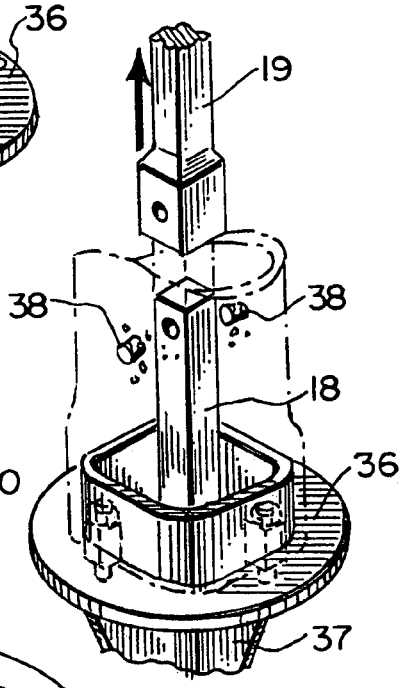
FIG. 13 is another partial, perspective view of the preferred embodiment of the apparatus of the present invention.

In FIGS. 13-13A, the apparatus 10 of the present invention is shown after placement and wherein the bore 26, 27, 28 of each of the sections 12, 13, 14 is filled with a suitable filler material such as concrete and rebar reinforcement. In such a case, the connection between the extension 18 of helical anchor 11 and the lower end portion 17 of drive section 19 is broken by simply pulling up on the various components of the drive member 15 to shear pin (eg. wood or plastic) 38 (see FIG. 13). At other locations such as the connection between drive section 19 and drive section 20, a strong bolted connection using bolt 39 and nut 40 can be provided as shown in FIG. 5, passing through openings 41 in drive member 19 and opening 42 in drive member 20.

FIGS. 6-9 and 10A-10B show a die construction for forming upper squared end portion 29 and lower squared end portion 30. A pair of dies 43, 44 can be provided, the die 43 being used for forming the lower squared end portion 30 and thus having a longitudinal dimension A that is longer than the corresponding dimension B of die 44, and a transverse dimension C that is smaller than the transverse dimension D of die 44. The die 43 in FIG. 6 forms the smaller cross sectional, but longitudinally longer lower squared end portion 30 whereas the die 44 in FIG. 7 forms the transversely wider but longitudinally shorter upper squared end portion 29.

Figure 8:
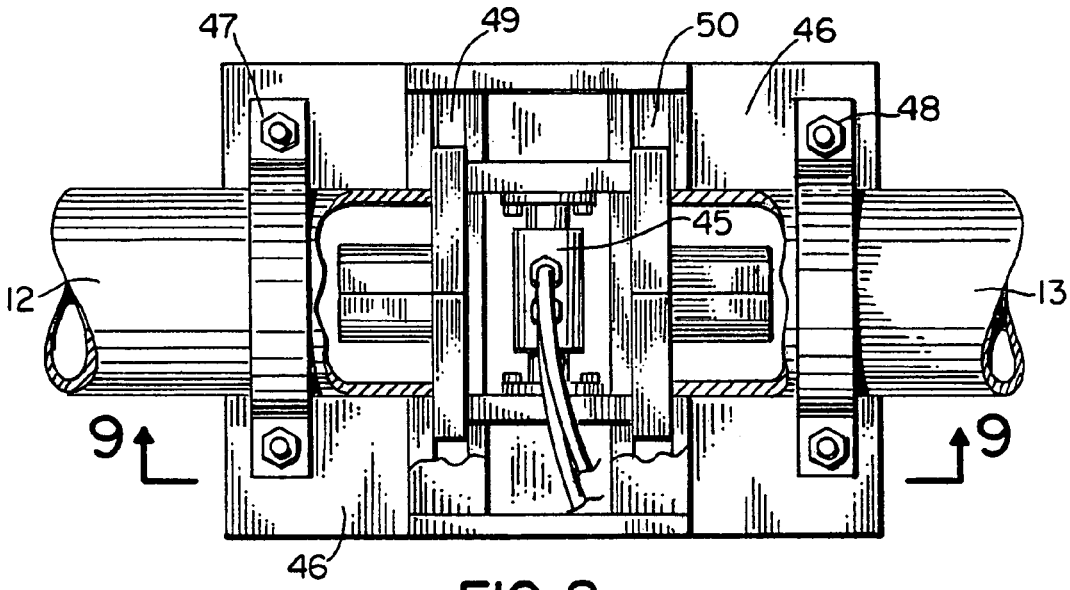
FIGS. 8 and 9 are plan and elevation views respectively that illustrate the method of forming the pile joint sections.
Figure 9:
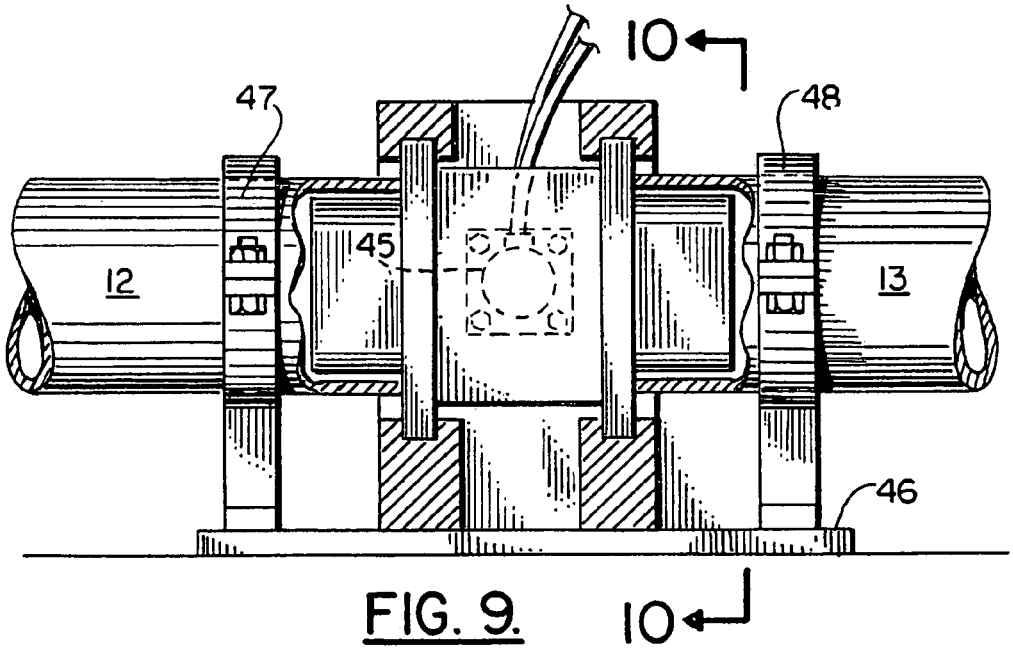
Figure 10:
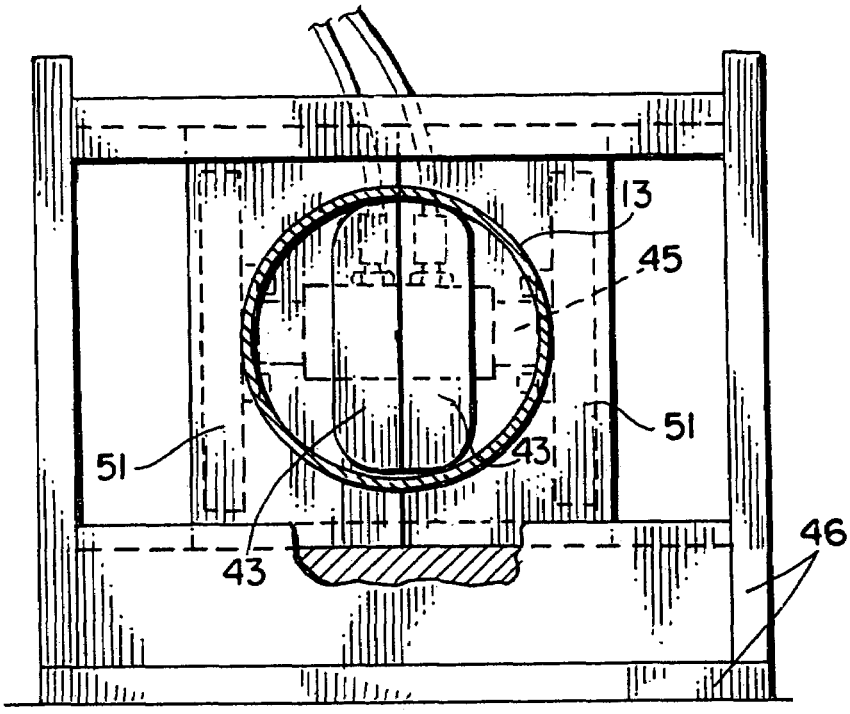
FIGS. 10 and 10A are schematic illustrations showing the formation of the joint sections that are at the end of each of the pile sections.
Figure 10A:
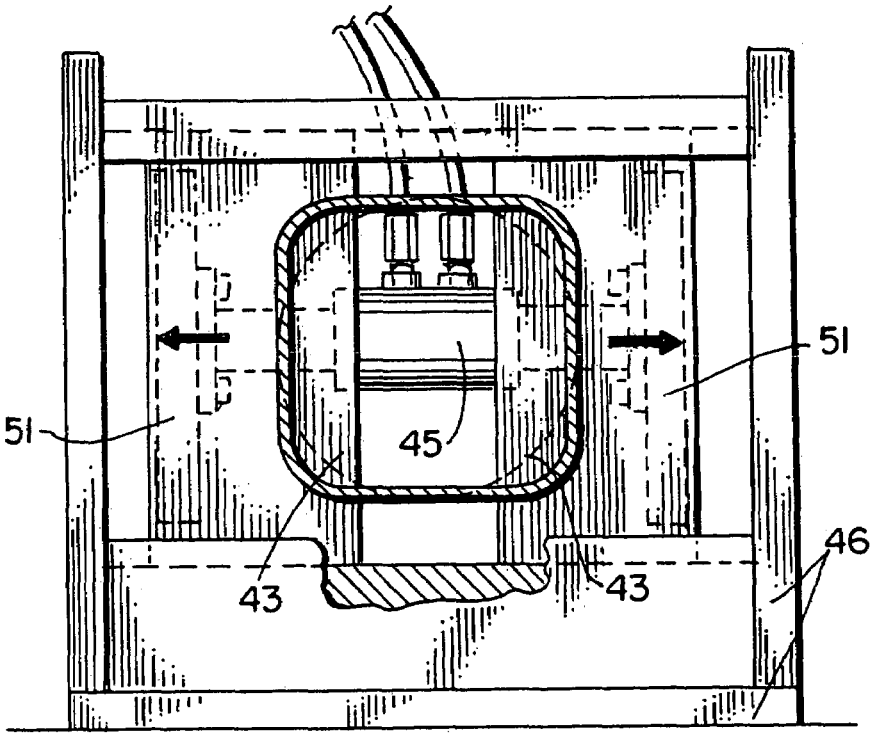

FIGS. 8 and 9 illustrate formation of these end portions 29 and 30 using a hydraulic jack 45 to force corresponding pairs of these dies 43, 44 apart while support 46 has clamp members 47, 48 that securely hold sections 12, 13. The support 46 thus functions as a slide top having runways 49, 50 that receive and track die supports 51, 52 that carry dies 43, 44 respectively.

Figure 12:
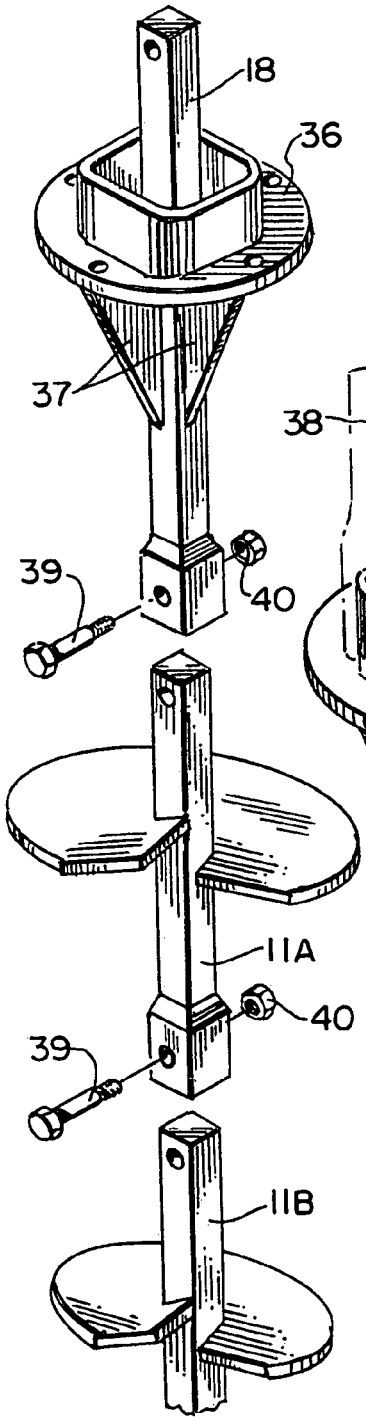
FIG. 12 is another partial, perspective view of the preferred embodiment of the apparatus of the present invention.

In FIG. 12, it should be understood that the helical anchor 11 can include a number of connected sections such as 11A, 11B connected together using bolted connections 39, 40 that are similar to the connections shown in FIG. 5.

Figure 14:
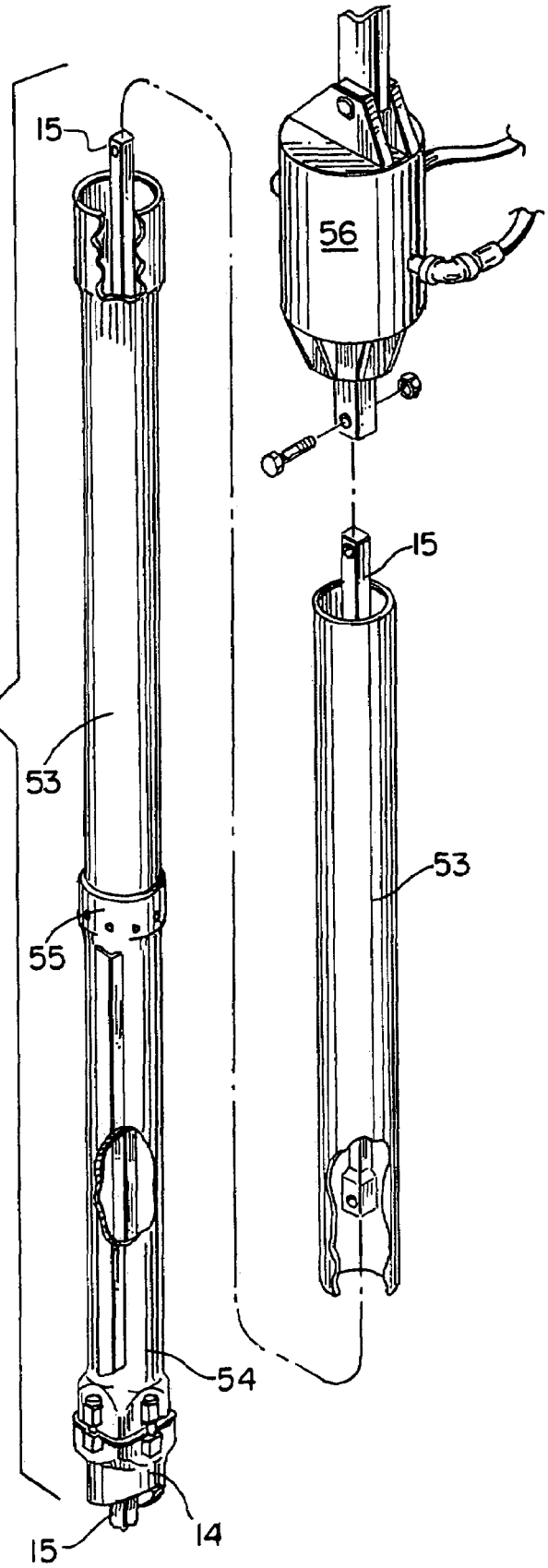
FIG. 14 is a partial, perspective view of the preferred embodiment of the apparatus of the present invention illustrating the hydraulic drive connected to the drive member, and showing an alternate construction that uses a hollow plastic section that is adapted for use in between a water bed and a water surface.

FIG. 14 illustrates a system that can be used in water wherein a plastic cylindrical pipe section or sections 53 can be joined to an uppermost section such as 12, 13, 14 using rivets and/or glue. In such a situations, the pile section that is the upper most section (such as section 13 or 14 in FIG. 1A) will be replaced with a transition section 54 having a circular connector 55 that receives the lower end portion of pipe section 53. The internal drive 15 extends through the plastic pipe section 53 for connecting with hydraulic drive 56. As shown in FIG. 14, more than one of the plastic pipe sections 53 can be employed, connected end to end and glued as is known in the art.

The embodiment of FIG. 14 can be used in aquatic environments wherein the pipe sections 53 extend between the mud line and the water line and/or can be used in any corrosive environment.

Figure 15:
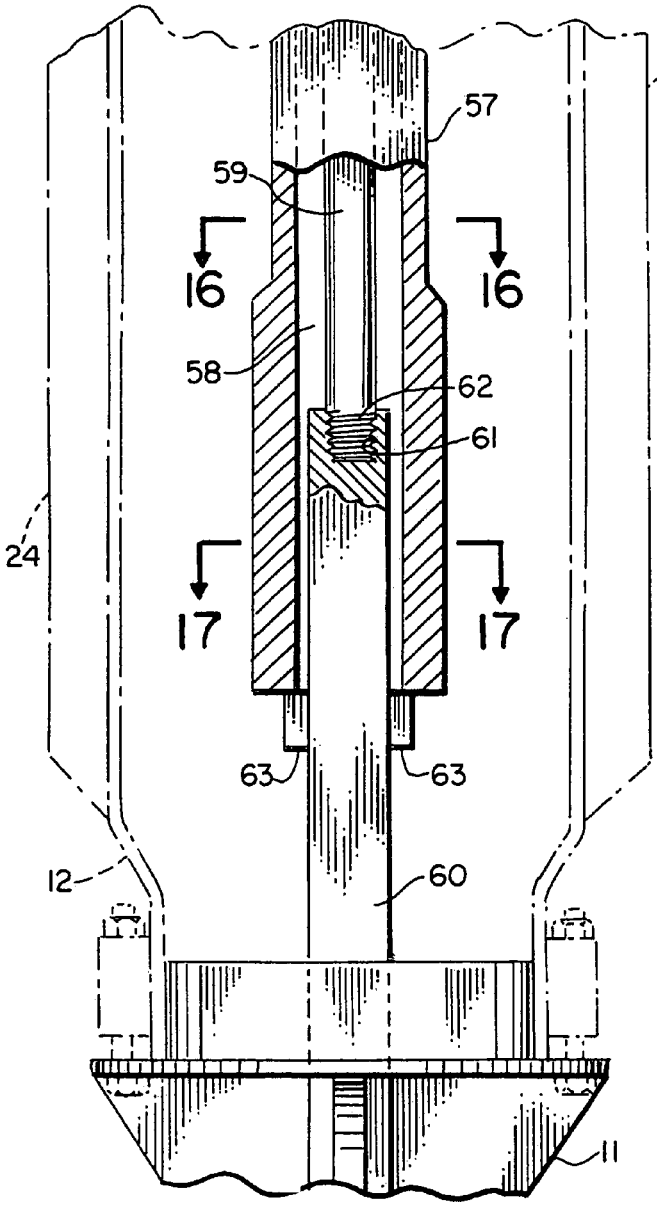
FIG. 15 is a partial elevation, sectional view of an alternate construction for the drive member.
Figure 16:
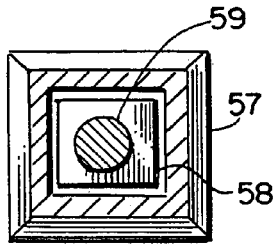
FIG. 16 is a sectional view taken along lines 16-16 of FIG. 15.
Figure 17:
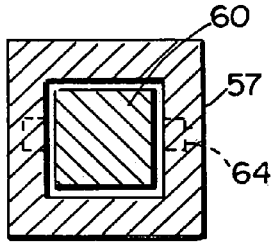
FIG. 17 is a sectional view taken along lines 17-17 of FIG. 15.
Figure 18:
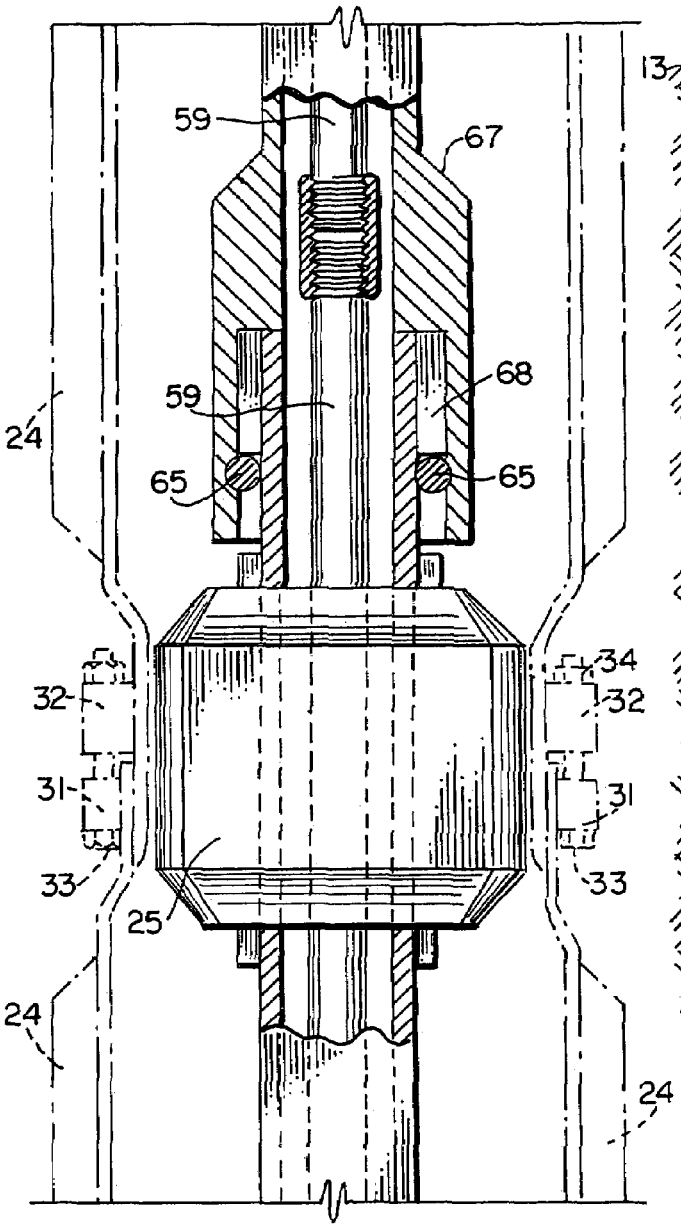
FIG. 18 is a partial, sectional elevation view illustrating an alternate construction for the internal drive member.
Figure 22:
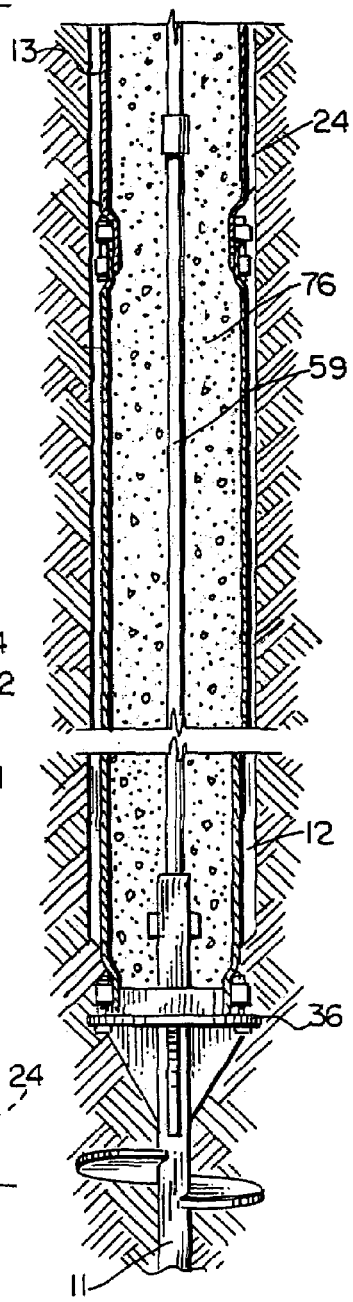
FIG. 22 is a sectional, elevation view showing the system of FIGS. 18-21 after installation.

FIGS. 15-17 shown an alternate arrangement for the internal drive member 15. In FIGS. 15-17, each of the internal drive members 15 is replaced with a specially configured drive member 57 wherein each of the drive members is hollow, providing a bore 58 that receives internally positioned rod 59. The extension 18 of anchor 11 is replaced with an extension 60 that has an upper end portion that is internally threaded at 61 to receive an externally threaded portion 62 at the lower end of rod 59 as shown in FIG. 15. This construction enables the drive member 57 to be removed, leaving the rod 59 behind for reinforcement purposes.

Radially extending projections 63 on extension 60 stop the drive tool 57 from slipping down the shaft 60. Torque can be imparted from drive member 57 to extension 60 and thus to helical anchor 11.

Figure 20:
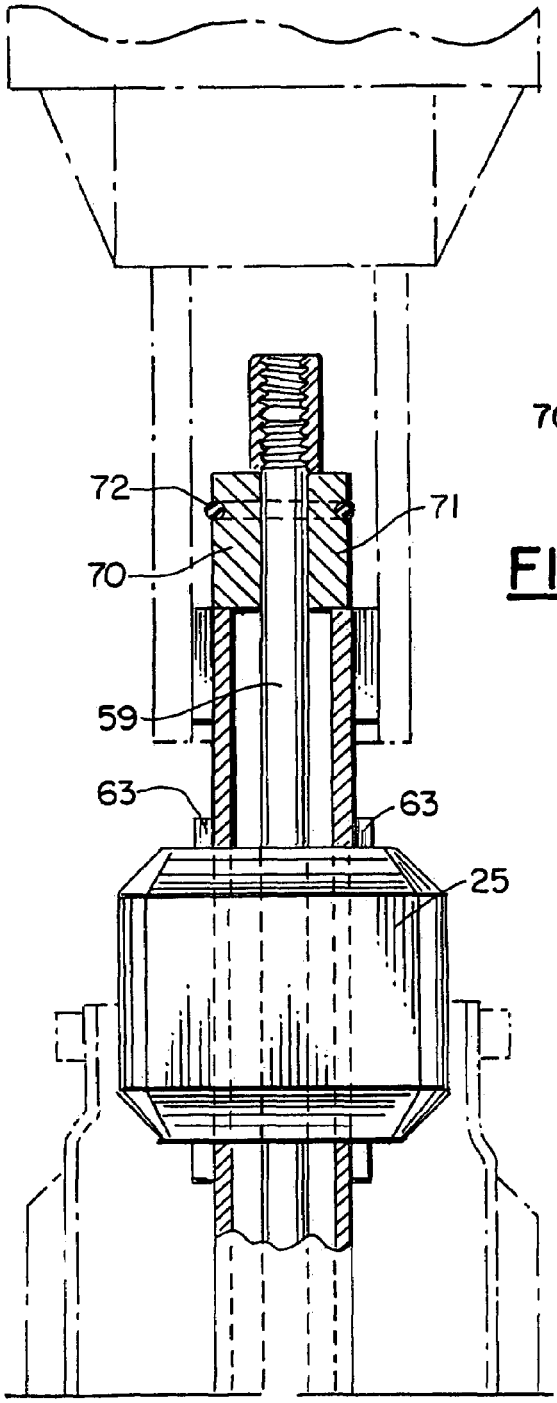
FIG. 20 is a partial, sectional elevation view illustrating the connection of FIGS. 18 and 19.
Figure 21:
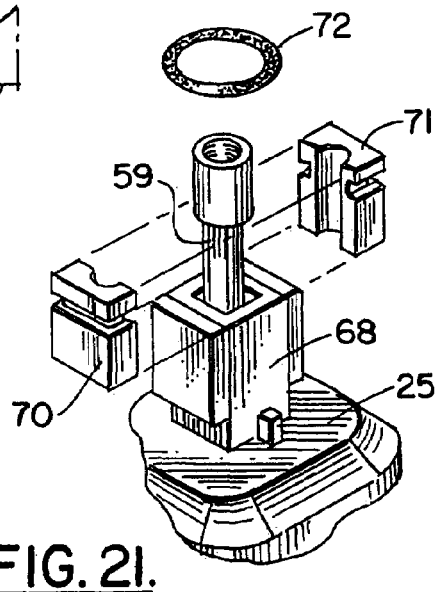
FIG. 21 is a partial, perspective, exploded view illustrating the connection of FIGS. 18-20.
Figure 19:
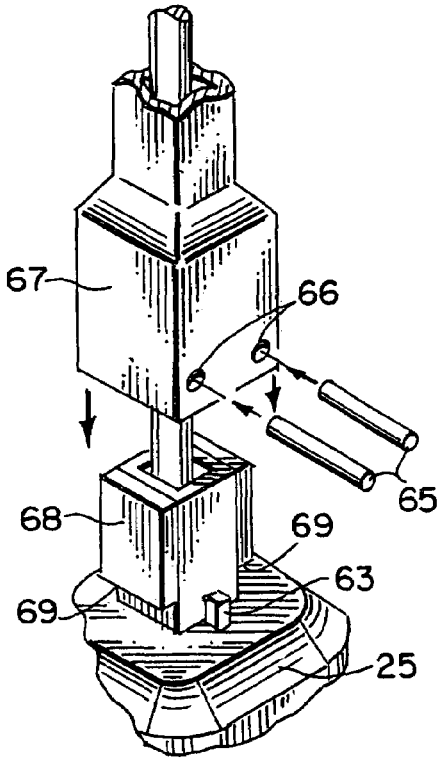
FIG. 19 is a partial perspective view of the connection shown in FIG. 18.

In order to remove the internal drive member 57, the operator simply lifts the drive member 57 off the stops 63, disengaging the drive tool 57 from extension 60. FIGS. 18-22 show another arrangement for connecting internal drive member 57 to an enlarged drive member 25 as shown in FIGS. 19-21.

In FIGS. 19-21, a pair of steel pins 65 are inserted through openings 66 when the lower end 67 of a drive member section is to be connected to another drive member section. The drive member section 67 fits over the fitting 68 above enlarged drive member 25 and pins 65 are placed through openings 66 and under horizontal surfaces 69.

FIG. 21 shows two (2) drive tool retainer clamps 70, 71 held together by the O-ring 72. The retainer clamps 70, 71 grip rod 59 and thus hold the shaft of the drive tool 57 to prevent it from moving up during installation, once the drive tool 57 is installed, the clamps 70, 71 are removed.

Figure 23:
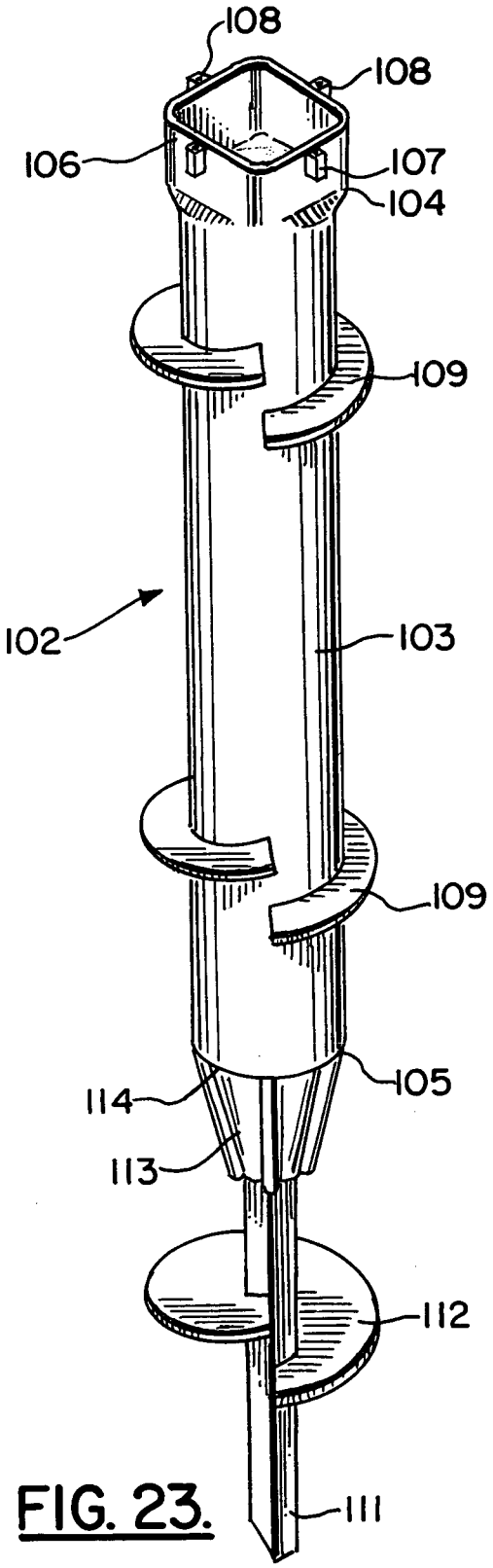
FIG. 23 is a perspective view of another alternate embodiment of the apparatus of the present invention.
Figure 24:
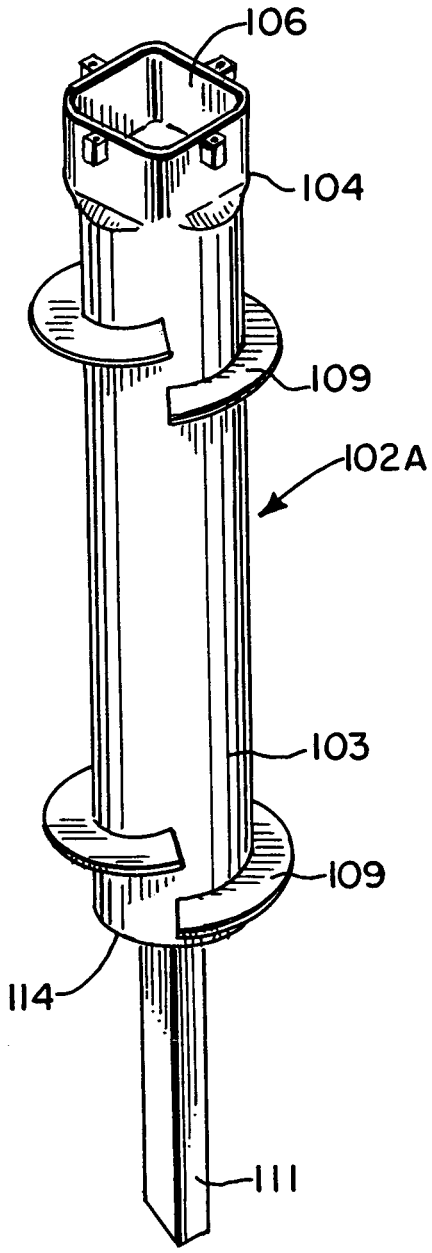
FIG. 24 is another perspective view of an alternate embodiment of the apparatus of the present invention.
Figure 25:
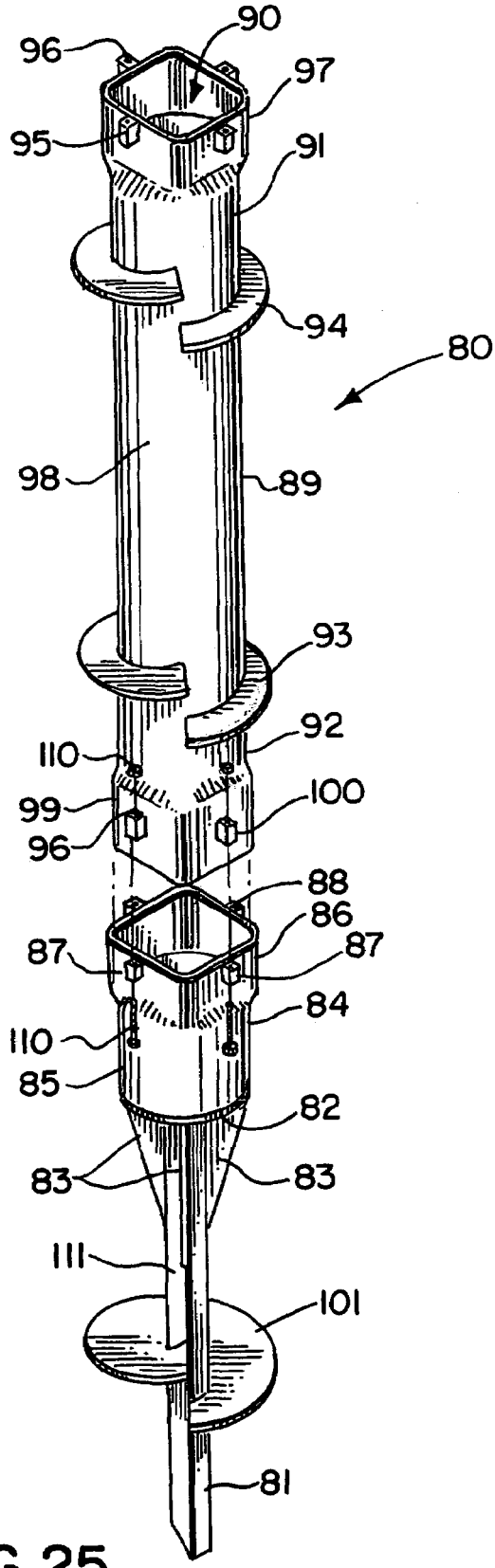
FIG. 25 is a perspective exploded view of an alternate embodiment of the apparatus of the present invention.
Figure 37:
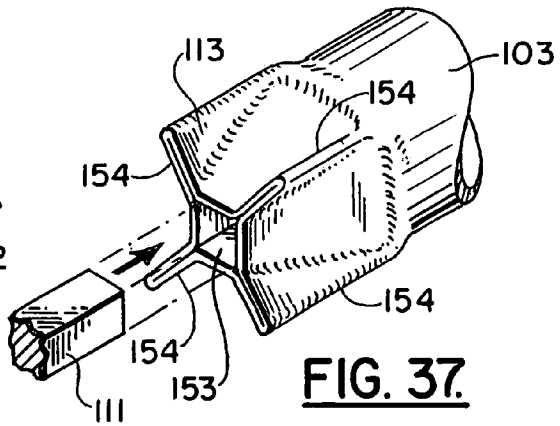
FIG. 37 is a fragmentary perspective view of an alternate embodiment of the apparatus of the present invention illustrating a joint between the helical anchor and the pile section.
Figure 36:
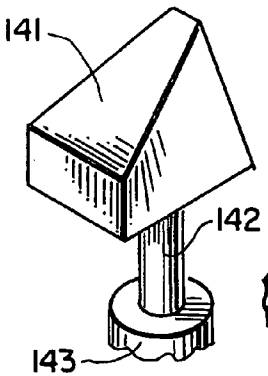
FIG. 36 is a partial perspective view of the swaging machine.
Figure 35:
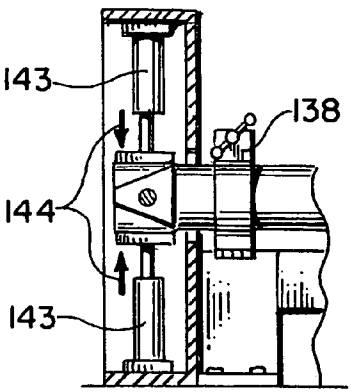
FIG. 35 is a fragmentary side view of the swaging machine of FIG. 33 illustrating a swaging of the end portion of the pile section.

FIGS. 23-39 show additional alternate embodiments of the apparatus of the present invention designated by the numeral 102 in FIG. 23, 102A in FIG. 24, and 80 in FIG. 25. Each of the piling apparatus shown in FIGS. 23-25 utilize a specially configured piling section having end portions that are not circular and so that they transfer rotation and torque, and that can be shaped using the apparatus show in FIGS. 27-32. One of the piling apparatus 102 of FIG. 23 has a swaged transition 113 that can be formed using the apparatus shown in FIGS. 35-37.

Each of the piling apparatus of FIG. 23-24 can be installed using hydraulic rotary driver 151 having drive tool 152 that engages one of the shaped end portions of the pile sections shown in FIGS. 23-25.

Piling apparatus 80 provides a lower, helical anchor section 81 that connects to cylindrical section 85 using circular plate 82 and triangular plates 83. The connection of circular plate 82 to cylindrical section 85 can be a welded connection. Similarly, the connection of triangular plates 83 to circular plate 82 and to helical anchor 81 can be welded connections. The helical anchor 81 provides one or more helical blades 101 that embed the piling apparatus 80 into a selected soil medium when uppermost shaped section 97 is rotated using hydraulic rotary driver 151.

Piling section 89 has an upper shaped (e.g. squared) non-circular section 86 provided with a plurality of lugs 95, each having an opening 96 through which a bolt can be attached when joining one more pile sections 89 together. Similarly, a lower squared section 99 has a plurality of lugs 100, each having an opening 96 that receives a bolted connection 110. In FIG. 25, the squared section 99 is a male section that fits squared section 86 of helical anchor 81. The squared section 86 provides lugs 87, each lug having an opening 88 that accepts a bolted connection 110. The cylindrically shaped central section 98 of piling section 89 is an unformed portion of the piling section 89. Thus, the piling section 89 can begin as a cylindrically shaped section of pipe such as schedule 10 or schedule 20 pipe, for example.

Piling section 89 provides a hollow bore and has upper and lower end portions 91, 92. One or more helical blades 93, 94 can be provided on the cylindrical section 98 of piling section 89, being welded thereto for example. A tapered transition section is provided and defined by plate 82, triangular plate sections 83, and the anchor shaft 111. In this fashion, the helical anchor 81 pulls the piling apparatus 90 into a selected soil medium when the apparatus 80 is rotated using hydraulic rotary driver 151.

In FIGS. 23 and 24, different transition sections are provided. Otherwise, the apparatus 102, 102A of FIGS. 23 and 24 is similarly driven into a selected soil medium using a hydraulic rotary driver 151. In FIGS. 23 and 24, piling apparatus 102, 102A includes a central cylindrically shaped section 103, upper end portion 104 and lower end portion 105. The upper end portion provides a shaped (e.g. squared) section 106 having lugs 107 with openings 108 that enable bolted connections 110 to be used to join a piling section 89 to the piling apparatus 102, 102A showing in FIG. 23 or 24. Anchor shaft 111 can be provided with one or more helical vanes 112.

In FIG. 23, a swaged joint 113 is provided at lower end portion 105. Additionally, a circular plate 114 can be welded at the joint between cylindrical section 103 and swaged joint 113. In FIG. 24, anchor shaft 111 extends to and through plate 114, being welded to it. A second or third or additional number of plates 114 can be positioned internally of cylindrical section 103, shaft 111 being welded thereto. FIGS. 26-32 show a fabrication device 115 that can be used to form the pile section 89 of FIG. 25, a plurality of such pile sections being connectable end-to-end and wherein a lower most of said pile sections 89 can be connected to helical anchor 81, pile apparatus 102, or pile apparatus 102A.

Fabrication device 115 includes a frame 116 that can be comprised of a plurality of transverse beams 117 and a plurality of longitudinal beams 118. The transverse beams 117 can be anchored (for example, bolted) to an underlying floor 119 or other suitable support.

Rails 120 are provided on longitudinal beams 118 for support a first carriage 121 and a second carriage 122. Carriage 121 has a pair of forming members 124, and 125, each being pivotally attached to first carriage 121 at pivot 123. Hydraulic cylinder 126 enables dies 129, 130 mounted respectively upon forming members 124, 125, to be moved together or apart. Hydraulic cylinder 126 can be attached to forming member 127 at pivotal connection 127. Hydraulic cylinder 126 can be attached to forming member 125 at pivotal connection 128.

Each forming member 124 has a die. The forming member 124 has die 129. The forming member 125 has die 130 (see FIGS. 26-32). Second carriage 122 has the same construction as first carriage 121 with the exception of die members 129A, 130A being of different dimensions than the die members 129, 130. The die members 129, 130 are used to form the male end portion of pile section 89 which is preferably a longer section. The die members 129A, 130A form the female end portion of piling section 89. The die members 129A, 130A are dimensioned so that when they form an end portion of pile section 131, the squared end portion 97 is a female section that is slightly larger than the squared end portion 99 that is a male end portion. Similarly, the squared section 86 is a female section that receives the squared end portion 99.

Figure 26:
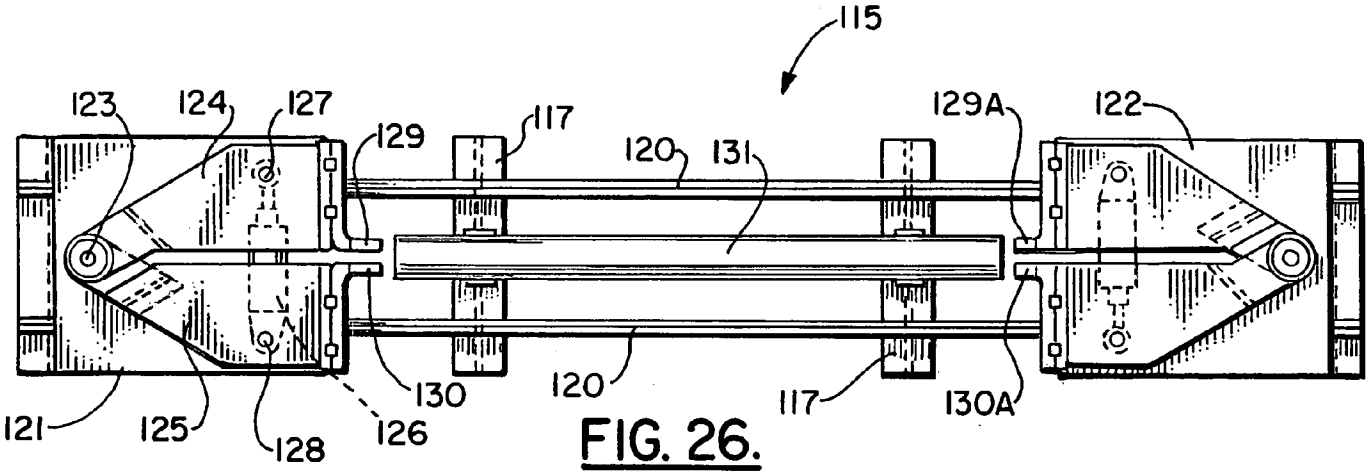
FIG. 26 is a plan view illustrating the die and forming apparatus for shaping the pile end portions for an alternate embodiment.
Figure 27:
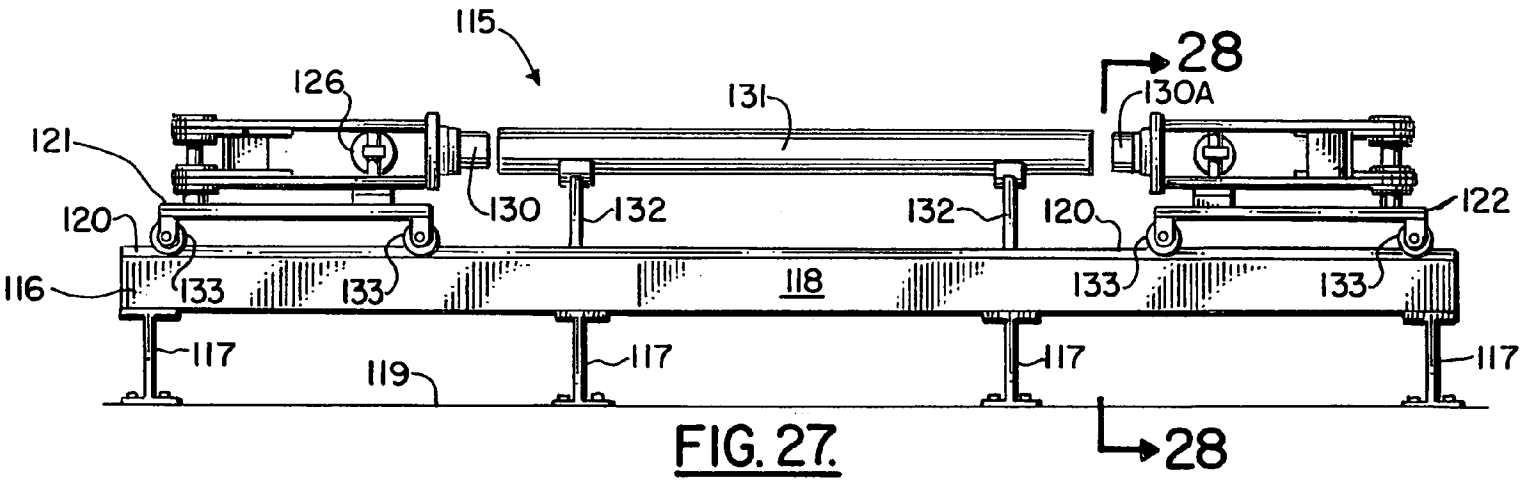
FIG. 27 is an elevation view of the forming apparatus of FIG. 26.
Figure 28:
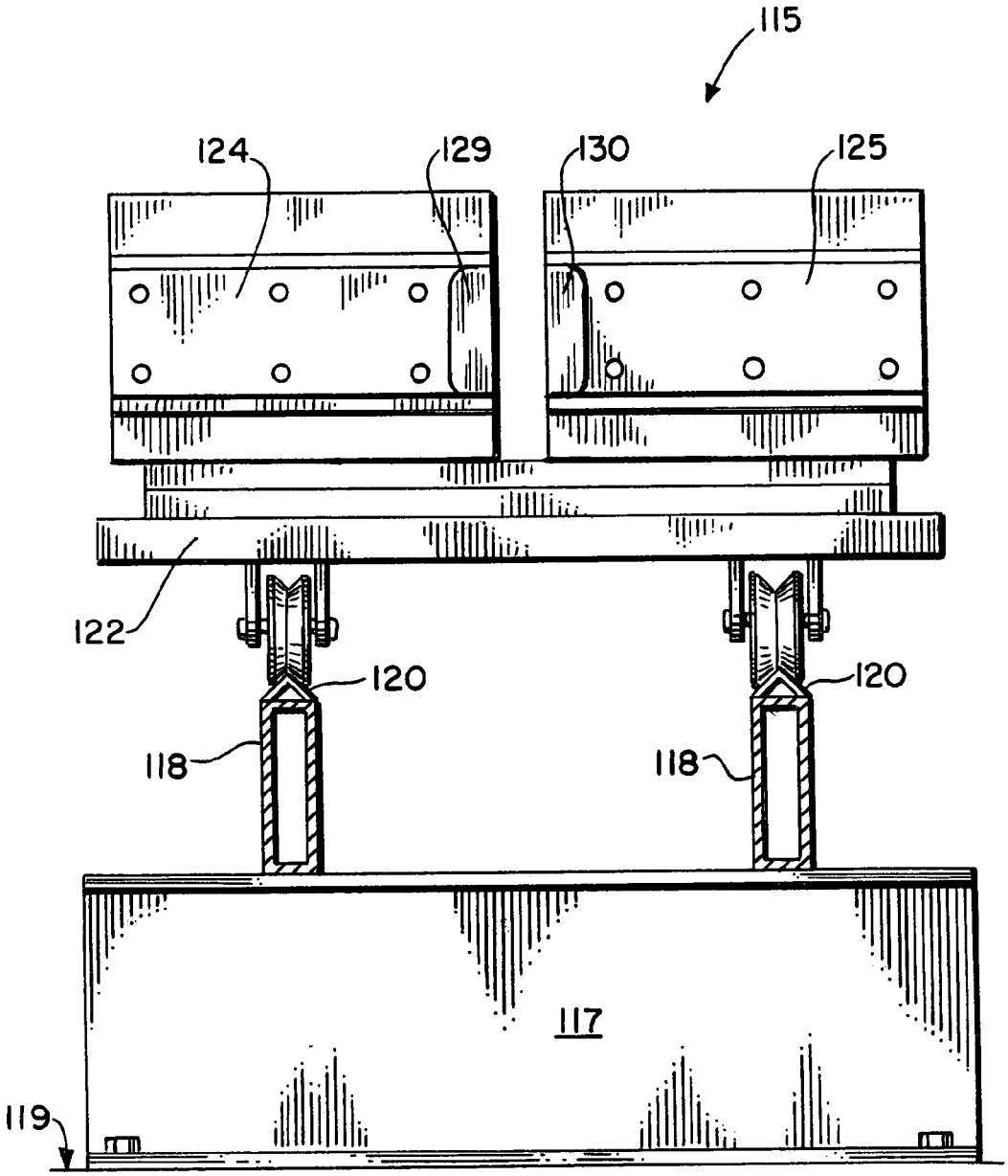
FIG. 28 is a sectional view taken along lines 28-28 of FIG. 27.
Figure 29:
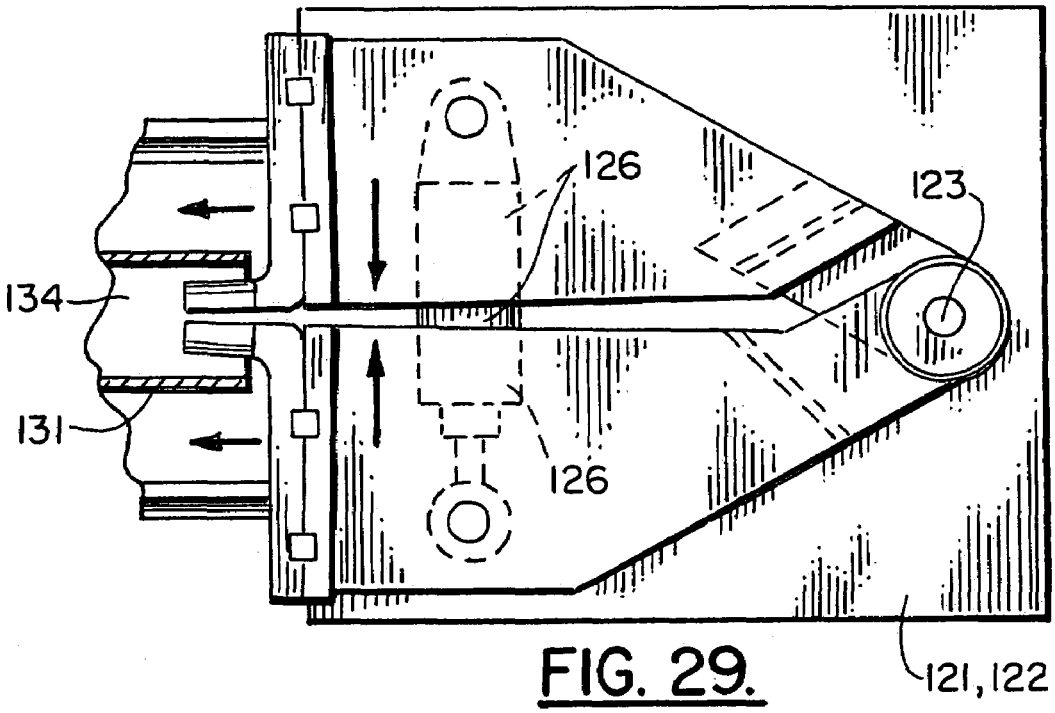
FIG. 29 is a fragmentary view of the forming apparatus portion of an alternate embodiment of the apparatus of the present invention.
Figure 30:
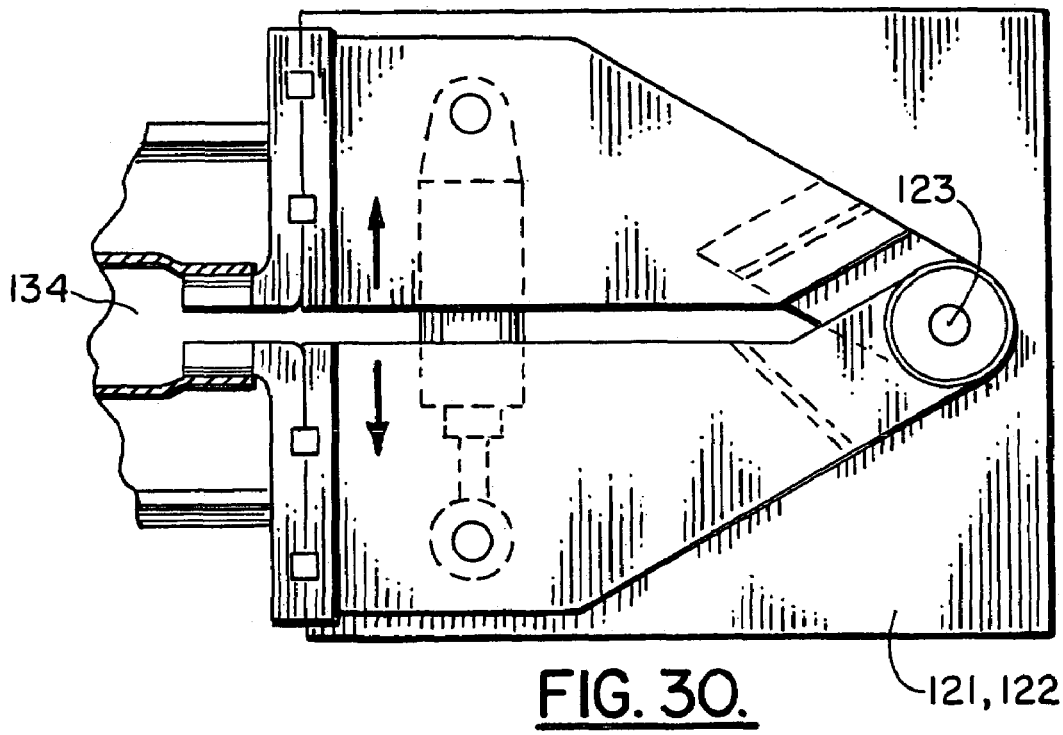
FIG. 30 is another fragmentary view of the forming apparatus portion of an alternate embodiment of the apparatus of the present invention.
Figure 31:
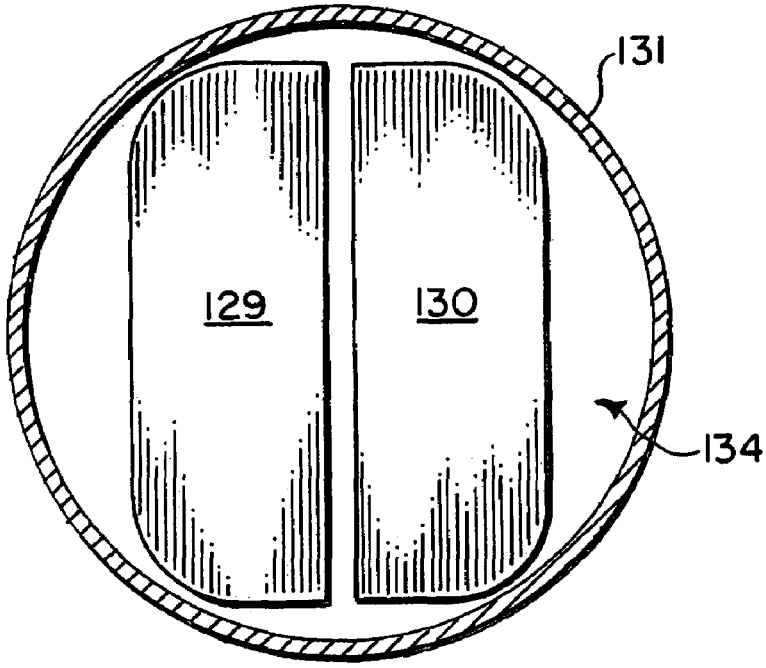
FIGS. 31-32 are schematic end views of a piling showing formation of the end portion of the piling section with the dies.
Figure 32:
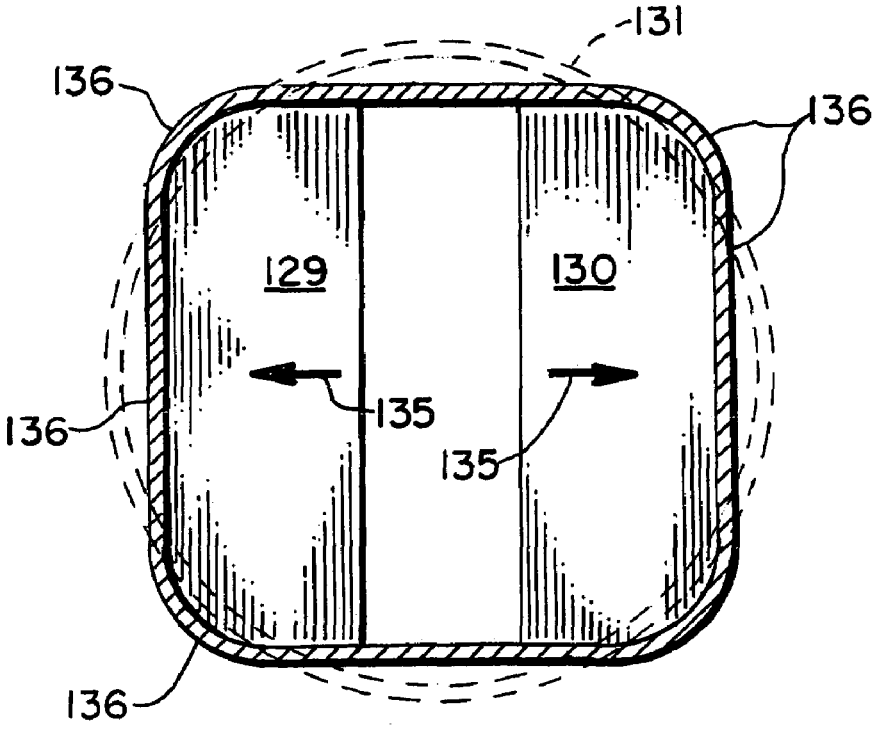
Figure 34:
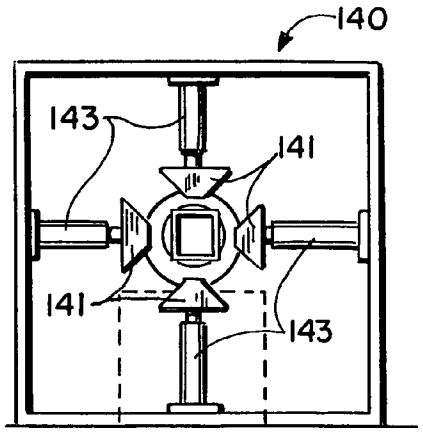
FIG. 34 is an end view of the swaging machine of FIG. 33.
Figure 33:
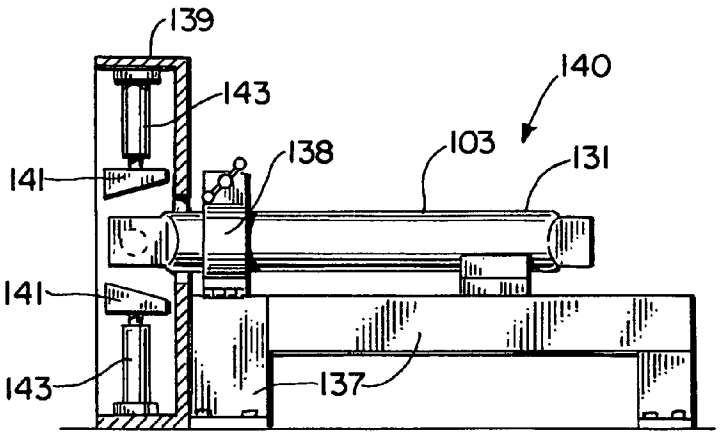
FIG. 33 is a fragmentary elevation view of an alternate embodiment of the apparatus of the present invention illustrating the swaging machine.

In FIG. 26, an unformed pile section 131 is shown resting upon supports 132. Each of the first and second carriages 121, 122 is provided with one or more casters or wheels 133 that ride upon rails 120. As shown in FIGS. 31 and 32, unformed pile section 131 has a bore 134 that is cylindrically shaped prior to forming (FIG. 31). The dies 129, 130 or 129A, 130A are expanded in the direction of arrows 135 (FIG. 32) when forming a squared end portion to form pile section 89 or helical anchor 81. The formed squared section 136 as shown in hard lines in FIG. 32 while the original cylindrical shape of unformed pile section 131 is shown in phantom lines in FIG. 32.

FIGS. 33-37 show a swaging device 140 that can be used to form the swaged joint 113 shown on piling apparatus 102 in FIG. 23. Swaging device 140 includes a support frame 139 for holding a section of conventional pipe or other unformed pile section 131 by grasping the cylindrical section 103 thereof. A plurality of shaped heads are mounted on pushrods 142 of hydraulic cylinders 143 that can be positioned about 90° apart as shown on FIG. 34.

These four hydraulic cylinders 143 are simultaneously activated to extend pushrods 142 in the direction of arrows 144 to engage a squared, shaped end portion 136 that has been formed using the apparatus of FIGS. 26-32. The completed swaged joint 113 as shown on FIG. 37 having a squared opening 153 that receives shaft 111 of pile apparatus 102. A weld can be used to join shaft 111 and swaged joint 113. Additionally, the folds 154 can be welded at the lower end portion of swaged joint 113 to provide additional strength. Additionally, one or more circular plates 114 can be welded inside of cylindrical section 103 and to shaft 111 for additional bracing and reinforcement.

Figure 38:
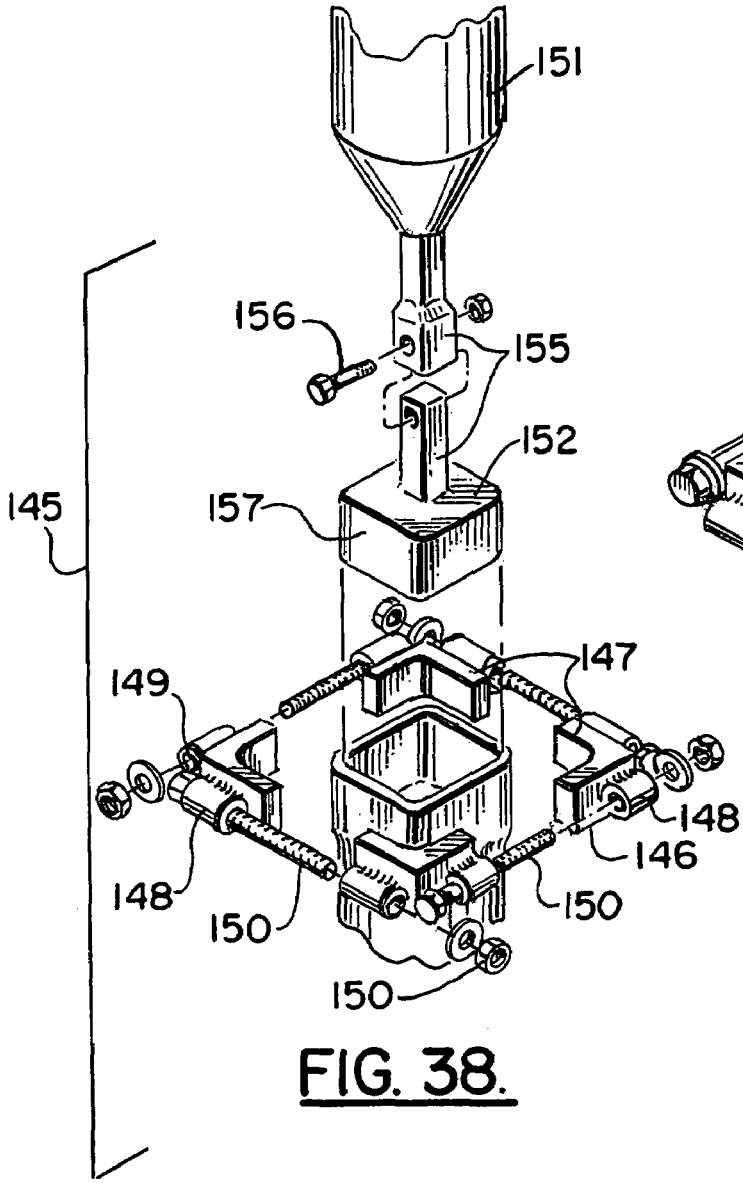
FIG. 38 is a partial perspective view of an alternate embodiment of the apparatus of the present invention illustrating the pile driving tool and its connection to the pile section; and, FIG. 39 is a partial perspective view of the alternate embodiment of the apparatus of the present invention illustrating the pile driving tool and its connection to the pile section.
Figure 39:
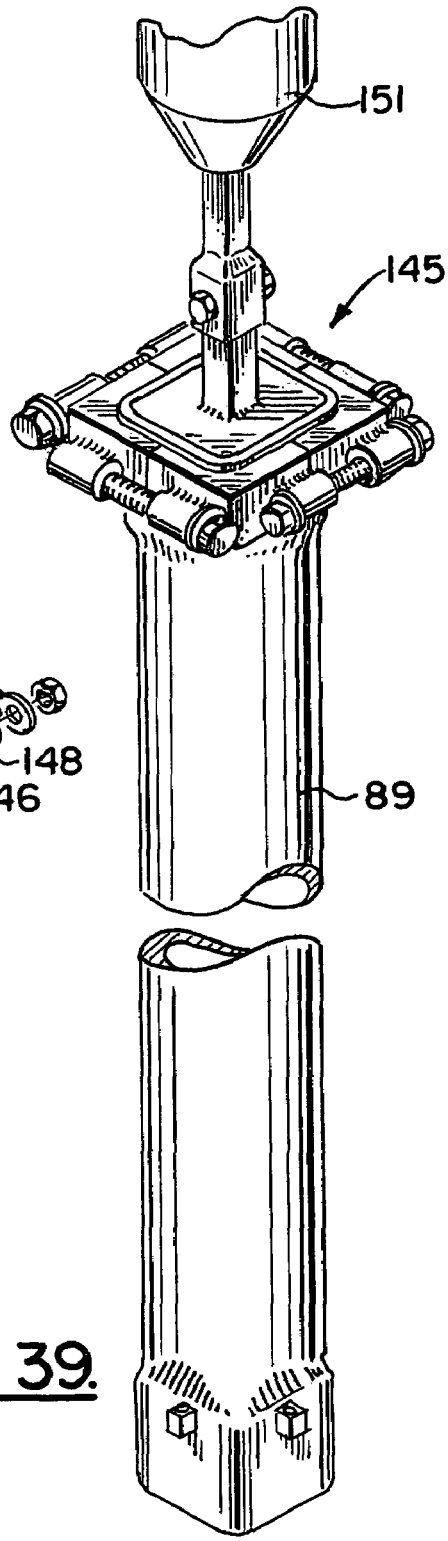

FIGS. 38 and 39 illustrate a suitable connection that joins hydraulic rotary drive 151 to pile section 89. Drive tool 152 can be removably attachable to rotary driver 151 using connection 155 such as the projection and socket shown with bolted connection 156 to attain the connection 155. Drive tool 152 has an enlarged, square drive member 157 that fits a female squared end portion 97 of pile section 89.

Connector 145 includes four ell shaped portions 147, each having a pair of sleeves 148 with sleeve openings 149 for receiving bolted connections 150. By tightening the bolted connections 150, the squared end portion 97 closely conforms to square drive 157 and reduces the chance of deformation or damage to squared end 97 if an operator should apply too much torque to hydraulic rotary driver 151. The brackets 146 that include ell shaped portions 147 and sleeves 148 can be of welded steel construction for example.

PARTS LIST

The following is a list of suitable parts and materials for the various elements of the preferred embodiment of the present invention.

| PART NO. | DESCRIPTION |
|---|---|
| 10 | in-situ pile apparatus |
| 11 | helical anchor, first section |
| 11A | anchor section |
| 11B | anchor section |
| 12 | second section |
| 13 | third section |
| 14 | fourth section |
| 15 | drive member |
| 16 | upper end portion |
| 17 | lower end portion |
| 18 | extension |
| 19 | drive section |
| 20 | drive section |
| 21 | drive section |
| 22 | lower connector |
| 23 | upper connector |
| 24 | rib |
| 25 | enlarged drive member |
| 26 | bore |
| 27 | bore |
| 28 | bore |
| 29 | upper square end portion |
| 30 | lower square end portion |
| 31 | lug |
| 32 | lug |
| 33 | bolt |
| 34 | nut |
| 35 | opening |
| 36 | round plate |
| 37 | triangular plate |
| 38 | shear pin |
| 39 | bolt |
| 40 | nut |
| 41 | opening |
| 42 | opening |
| 43 | die |
| 44 | die |
| 45 | jack |
| 46 | support |
| 47 | clamp |
| 48 | clamp |
| 49 | runway |
| 50 | runway |
| 51 | die support |
| 52 | die support |
| 53 | pipe section |
| 54 | transition section |
| 55 | connector |
| 56 | hydraulic drive |

-continued

| PART NO. | DESCRIPTION |
|---|---|
| 57 | internal drive member |
| 58 | bore |
| 59 | rod |
| 60 | extension |
| 61 | internal thread |
| 62 | external thread |
| 63 | tool stops |
| 64 | stops below drive tool |
| 65 | pin |
| 66 | opening |
| 67 | lower end |
| 68 | fitting |
| 69 | horizontal surface |
| 70 | retainer clamp |
| 71 | retainer clamp |
| 72 | O-ring |
| 73 | socket |
| 74 | socket |
| 75 | opening |
| 76 | concrete |
| A | dimension arrow |
| B | dimension arrow |
| C | dimension arrow |
| D | dimension arrow |
| 80 | piling apparatus |
| 81 | helical anchor |
| 82 | circular plate |
| 83 | triangular plate |
| 84 | sleeve |
| 85 | cylindrical section |
| 86 | squared section |
| 87 | lug |
| 88 | opening |
| 89 | piling section |
| 90 | hollow bore |
| 91 | upper end |
| 92 | lower end |
| 93 | helical blade |
| 94 | helical blade |
| 95 | lug |
| 96 | opening |
| 97 | squared section |
| 98 | cylindrical section |
| 99 | squared section |
| 100 | lug |
| 101 | helical blade |
| 102 | piling apparatus |
| 102A | piling apparatus |
| 103 | cylindrical section |
| 104 | upper end |
| 105 | lower end |
| 106 | squared section |
| 107 | lug |
| 108 | opening |
| 109 | helical vane |
| 110 | bolted connection |
| 111 | anchor shaft |
| 112 | helical vane |
| 113 | swaged joint |
| 114 | circular plate |
| 115 | fabrication device |
| 116 | frame |
| 117 | transverse beam |
| 118 | longitudinal beam |
| 119 | floor |
| 120 | vail |
| 121 | first carriage |
| 122 | second carriage |
| 123 | pivot |
| 124 | forming member |
| 125 | forming member |
| 126 | hydraulic cylinder |
| 127 | pivotal connection |
| 128 | pivotal connection |
| 129 | die |
| 129A | die |
| 130 | die |

-continued

| PART NO. | DESCRIPTION |
|---|---|
| 130A | die |
| 131 | uniformed pile section |
| 132 | support |
| 133 | caster |
| 134 | bore |
| 135 | arrow |
| 136 | formed, squared section |
| 137 | pile support |
| 138 | clamp |
| 139 | support frame |
| 140 | swaging device |
| 141 | shaped head |
| 142 | pushrod |
| 143 | hydraulic cylinder |
| 144 | arrow |
| 145 | connector |
| 146 | bracket |
| 147 | ell shaped portion |
| 148 | sleeve |
| 149 | sleeve opening |
| 150 | bolted connection |
| 151 | hydraulic rotary driver |
| 152 | drive tool |
| 153 | squared opening |
| 154 | fold |
| 155 | connection |
| 156 | bolted connection |
| 157 | square drive |
| 158 | |

The foregoing embodiments are presented by way of example only; the scope of the present invention is to be limited only by the following claims.

The invention claimed is:

1. A multi-section pile apparatus, comprising:

a. a lowermost anchor that is configured to be driven into a soil mass by rotation, the anchor having a solid shaft and a helically threaded vane portion attached thereto;

b. a plurality of pile sections that are connectable end-to-end at non-annular joint portions, the pile sections and joint portions having hollow bores, a lowermost of the pile sections being connectable to a top of the anchor, wherein the pile sections have end portions that are shaped to fit a squared end portion of another pile section in telescoping fashion and wherein each of the pile sections carries a plurality of circumferentially spaced radially extending soil displacement ribs;

c. a rotary drive means for transmitting rotational force to the pile sections and the anchor, said drive means comprising drive members that fit is inside end portions of the pile sections; and d. wherein the joint portions are configured with non-annular surfaces that enable torque to be transmitted from the rotary drive to the pile sections.

* * * * *